US008348181B2

(12) United States Patent
Whitaker et al.

(10) Patent No.: US 8,348,181 B2
(45) Date of Patent: Jan. 8, 2013

(54) SHOWER ASSEMBLY WITH RADIAL MODE CHANGER

(75) Inventors: Carl T. Whitaker, Berthoud, CO (US); Leland C. Leber, Fort Collins, CO (US); Brian Randall Williams, Fort Collins, CO (US)

(73) Assignee: Water Pik, Inc., Fort Collins, CO (US)

( * ) Notice: Subject to any disclaimer, the term of this patent is extended or adjusted under 35 U.S.C. 154(b) by 594 days.

(21) Appl. No.: 12/560,041

(22) Filed: Sep. 15, 2009

(65) Prior Publication Data

US 2010/0065665 A1 Mar. 18, 2010

Related U.S. Application Data

(60) Provisional application No. 61/097,069, filed on Sep. 15, 2008.

(51) Int. Cl.
*B05B 1/18* (2006.01)
*B05B 1/16* (2006.01)
*B05B 1/14* (2006.01)

(52) U.S. Cl. ..... 239/447; 239/443; 239/449; 239/559; 239/560; 239/581.1

(58) Field of Classification Search ..... 239/436, 239/443, 444, 446–449, 548, 556, 558–562, 239/567, 581.1
See application file for complete search history.

(56) References Cited

U.S. PATENT DOCUMENTS

| | | | |
|---|---|---|---|
| 203,094 | A | 4/1878 | Wakeman |
| 204,333 | A | 5/1878 | Josias |
| 309,349 | A | 12/1884 | Hart |
| 428,023 | A | 5/1890 | Schoff |
| 432,712 | A | 7/1890 | Taylor |
| 445,250 | A | 1/1891 | Lawless |
| 453,109 | A | 5/1891 | Dreisorner |
| 486,986 | A | 11/1892 | Schinke |
| 566,384 | A | 8/1896 | Engelhart |
| 566,410 | A | 8/1896 | Schinke |
| 570,405 | A | 10/1896 | Jerguson et al. |
| 694,888 | A | 3/1902 | Pfluger |

(Continued)

FOREIGN PATENT DOCUMENTS

| | | |
|---|---|---|
| CA | 659510 | 3/1963 |

(Continued)

OTHER PUBLICATIONS

Gemlo, available at least as early as Dec. 2, 1998.

*Primary Examiner* — Darren W Gorman
(74) *Attorney, Agent, or Firm* — Dorsey & Whitney LLP

(57) ABSTRACT

A shower assembly having a plurality of spray modes for expelling water includes a housing having a water inflow and a water outflow. The shower assembly provides a manifold defining a cavity having a sidewall. One or more mode apertures formed in the sidewall of the cavity are in fluid communication with the water outflow. A radial mode changer provided in the shower assembly defines a hollow passageway in fluid communication with the water inflow, and further defines a plurality of recessed ports in fluid communication with the hollow passageway. The radial mode changer is rotatably received in the cavity of the manifold and may be rotated relative to the manifold to align at least one of the recessed ports with at least one of the mode apertures for providing flow from the water inflow into the water outflow via the radial mode changer.

14 Claims, 21 Drawing Sheets

U.S. PATENT DOCUMENTS

| | | | |
|---|---|---|---|
| 800,802 | A | 10/1905 | Franquist |
| 832,523 | A | 10/1906 | Andersson |
| 835,678 | A | 11/1906 | Hammond |
| 845,540 | A | 2/1907 | Ferguson |
| 854,094 | A | 5/1907 | Klein |
| 926,929 | A | 7/1909 | Dusseau |
| 1,001,842 | A | 8/1911 | Greenfield |
| 1,003,037 | A | 9/1911 | Crowe |
| 1,018,143 | A | 2/1912 | Vissering |
| 1,046,573 | A | 12/1912 | Ellis |
| 1,130,520 | A | 3/1915 | Kenney |
| 1,203,466 | A | 10/1916 | Benson |
| 1,217,254 | A | 2/1917 | Winslow |
| 1,218,895 | A | 3/1917 | Porter |
| 1,255,577 | A | 2/1918 | Berry |
| 1,260,181 | A | 3/1918 | Garnero |
| 1,276,117 | A | 8/1918 | Riebe |
| 1,284,099 | A | 11/1918 | Harris |
| 1,327,428 | A | 1/1920 | Gregory |
| 1,451,800 | A | 4/1923 | Agner |
| 1,459,582 | A | 6/1923 | Dubee |
| 1,469,528 | A | 10/1923 | Owens |
| 1,500,921 | A | 7/1924 | Bramson et al. |
| 1,560,789 | A | 11/1925 | Johnson et al. |
| 1,597,477 | A | 8/1926 | Panhorst |
| 1,633,531 | A | 6/1927 | Keller |
| 1,692,394 | A | 11/1928 | Sundh |
| 1,695,263 | A | 12/1928 | Jacques |
| 1,724,147 | A | 8/1929 | Russell |
| 1,724,161 | A | 8/1929 | Wuesthoff |
| 1,736,160 | A | 11/1929 | Jonsson |
| 1,754,127 | A | 4/1930 | Srulowitz |
| 1,758,115 | A | 5/1930 | Kelly |
| 1,778,658 | A | 10/1930 | Baker |
| 1,821,274 | A | 9/1931 | Plummer |
| 1,849,517 | A | 3/1932 | Fraser |
| 1,890,156 | A | 12/1932 | Konig |
| 1,906,575 | A | 5/1933 | Goeriz |
| 1,934,553 | A | 11/1933 | Mueller et al. |
| 1,946,207 | A | 2/1934 | Haire |
| 2,011,446 | A | 8/1935 | Judell |
| 2,024,930 | A | 12/1935 | Judell |
| 2,033,467 | A | 3/1936 | Groeniger |
| 2,044,445 | A | 6/1936 | Price et al. |
| 2,085,854 | A | 7/1937 | Hathaway et al. |
| 2,096,912 | A | 10/1937 | Morris |
| 2,117,152 | A | 5/1938 | Crosti |
| D113,439 | S | 2/1939 | Reinecke |
| 2,196,783 | A | 4/1940 | Shook |
| 2,197,667 | A | 4/1940 | Shook |
| 2,216,149 | A | 10/1940 | Weiss |
| D126,433 | S | 4/1941 | Enthof |
| 2,251,192 | A | 7/1941 | Krumsiek et al. |
| 2,268,263 | A | 12/1941 | Newell et al. |
| 2,285,831 | A | 6/1942 | Pennypacker |
| 2,342,757 | A | 2/1944 | Roser |
| 2,402,741 | A | 6/1946 | Draviner |
| D147,258 | S | 8/1947 | Becker |
| D152,584 | S | 2/1949 | Becker |
| 2,467,954 | A | 4/1949 | Becker |
| 2,546,348 | A | 3/1951 | Schuman |
| 2,567,642 | A | 9/1951 | Penshaw |
| 2,581,129 | A | 1/1952 | Muldoon |
| D166,073 | S | 3/1952 | Dunkelberger |
| 2,648,762 | A | 8/1953 | Dunkelberger |
| 2,664,271 | A | 12/1953 | Arutunoff |
| 2,671,693 | A | 3/1954 | Hyser et al. |
| 2,676,806 | A | 4/1954 | Bachman |
| 2,679,575 | A | 5/1954 | Haberstump |
| 2,680,358 | A | 6/1954 | Zublin |
| 2,726,120 | A | 12/1955 | Bletcher et al. |
| 2,759,765 | A | 8/1956 | Pawley |
| 2,776,168 | A | 1/1957 | Schweda |
| 2,792,847 | A | 5/1957 | Spencer |
| 2,873,999 | A | 2/1959 | Webb |
| 2,930,505 | A | 3/1960 | Meyer |
| 2,931,672 | A | 4/1960 | Merritt et al. |
| 2,935,265 | A | 5/1960 | Richter |
| 2,949,242 | A | 8/1960 | Blumberg et al. |
| 2,957,587 | A | 10/1960 | Tobin |
| 2,966,311 | A | 12/1960 | Davis |
| D190,295 | S | 5/1961 | Becker |
| 2,992,437 | A | 7/1961 | Nelson et al. |
| 3,007,648 | A | 11/1961 | Fraser |
| D192,935 | S | 5/1962 | Becker |
| 3,032,357 | A | 5/1962 | Shames et al. |
| 3,034,809 | A | 5/1962 | Greenberg |
| 3,037,799 | A | 6/1962 | Mulac |
| 3,081,339 | A | 3/1963 | Green et al. |
| 3,092,333 | A | 6/1963 | Gaiotto |
| 3,098,508 | A | 7/1963 | Gerdes |
| 3,103,723 | A | 9/1963 | Becker |
| 3,104,815 | A | 9/1963 | Schultz |
| 3,104,827 | A | 9/1963 | Aghnides |
| 3,111,277 | A | 11/1963 | Grimsley |
| 3,112,073 | A | 11/1963 | Larson et al. |
| 3,143,857 | A | 8/1964 | Eaton |
| 3,196,463 | A | 7/1965 | Farneth |
| 3,231,200 | A | 1/1966 | Heald |
| 3,236,545 | A | 2/1966 | Parkes et al. |
| 3,239,152 | A | 3/1966 | Bachli et al. |
| 3,266,059 | A | 8/1966 | Stelle |
| 3,272,437 | A | 9/1966 | Coson |
| 3,273,359 | A | 9/1966 | Fregeolle |
| 3,306,634 | A | 2/1967 | Groves et al. |
| 3,323,148 | A | 6/1967 | Burnon |
| 3,329,967 | A | 7/1967 | Martinez et al. |
| 3,341,132 | A | 9/1967 | Parkison |
| 3,342,419 | A | 9/1967 | Weese |
| 3,344,994 | A | 10/1967 | Fife |
| 3,363,842 | A | 1/1968 | Burns |
| 3,383,051 | A | 5/1968 | Fiorentino |
| 3,389,925 | A | 6/1968 | Gottschald |
| 3,393,311 | A | 7/1968 | Dahl |
| 3,393,312 | A | 7/1968 | Dahl |
| 3,404,410 | A | 10/1968 | Sumida |
| 3,492,029 | A | 1/1970 | French et al. |
| 3,516,611 | A | 6/1970 | Piggott |
| 3,546,961 | A | 12/1970 | Marton |
| 3,550,863 | A | 12/1970 | McDermott |
| 3,552,436 | A | 1/1971 | Stewart |
| 3,565,116 | A | 2/1971 | Gabin |
| 3,566,917 | A | 3/1971 | White |
| 3,580,513 | A | 5/1971 | Martin |
| 3,584,822 | A | 6/1971 | Oram |
| 3,596,835 | A | 8/1971 | Smith et al. |
| 3,612,577 | A | 10/1971 | Pope |
| 3,637,143 | A | 1/1972 | Shames et al. |
| 3,641,333 | A | 2/1972 | Gendron |
| 3,647,144 | A | 3/1972 | Parkison et al. |
| 3,663,044 | A | 5/1972 | Contreras et al. |
| 3,669,470 | A | 6/1972 | Deurloo |
| 3,672,648 | A | 6/1972 | Price |
| 3,682,392 | A | 8/1972 | Kint |
| 3,685,745 | A | 8/1972 | Peschcke-Koedt |
| D224,834 | S | 9/1972 | Laudell |
| 3,711,029 | A | 1/1973 | Bartlett |
| 3,722,798 | A | 3/1973 | Bletcher et al. |
| 3,722,799 | A | 3/1973 | Rauh |
| 3,731,084 | A | 5/1973 | Trevorrow |
| 3,754,779 | A | 8/1973 | Peress |
| D228,622 | S | 10/1973 | Jublin |
| 3,762,648 | A | 10/1973 | Deines et al. |
| 3,768,735 | A | 10/1973 | Ward |
| 3,786,995 | A | 1/1974 | Manoogian et al. |
| 3,801,019 | A | 4/1974 | Trenary et al. |
| 3,810,580 | A | 5/1974 | Rauh |
| 3,826,454 | A | 7/1974 | Zieger |
| 3,840,734 | A | 10/1974 | Oram |
| 3,845,291 | A | 10/1974 | Portyrata |
| 3,860,271 | A | 1/1975 | Rodgers |
| 3,861,719 | A | 1/1975 | Hand |
| 3,865,310 | A | 2/1975 | Elkins et al. |
| 3,869,151 | A | 3/1975 | Fletcher et al. |
| 3,896,845 | A | 7/1975 | Parker |
| 3,902,671 | A | 9/1975 | Symmons |
| 3,910,277 | A | 10/1975 | Zimmer |

D237,708 S 11/1975 Grohe
3,929,164 A 12/1975 Richter
3,929,287 A 12/1975 Givler et al.
3,958,756 A 5/1976 Trenary et al.
D240,322 S 6/1976 Staub
3,967,783 A 7/1976 Halsted et al.
3,979,096 A 9/1976 Zieger
3,997,116 A 12/1976 Moen
3,998,390 A 12/1976 Peterson et al.
3,999,714 A 12/1976 Lang
4,005,880 A 2/1977 Anderson et al.
4,006,920 A 2/1977 Sadler et al.
4,023,782 A 5/1977 Eifer
4,042,984 A 8/1977 Butler
4,045,054 A 8/1977 Arnold
D245,858 S 9/1977 Grube
D245,860 S 9/1977 Grube
4,068,801 A 1/1978 Leutheuser
4,081,135 A 3/1978 Tomaro
4,084,271 A 4/1978 Ginsberg
4,091,998 A 5/1978 Peterson
D249,356 S 9/1978 Nagy
4,117,979 A 10/1978 Lagarelli et al.
4,129,257 A 12/1978 Eggert
4,130,120 A 12/1978 Kohler, Jr.
4,131,233 A 12/1978 Koenig
4,133,486 A 1/1979 Fanella
4,135,549 A 1/1979 Baker
D251,045 S 2/1979 Grube
4,141,502 A 2/1979 Grohe
4,151,955 A 5/1979 Stouffer
4,151,957 A 5/1979 Gecewicz et al.
4,162,801 A 7/1979 Kresky et al.
4,165,837 A 8/1979 Rundzaitis
4,167,196 A 9/1979 Morris
4,174,822 A 11/1979 Larsson
4,185,781 A 1/1980 O'Brien
4,190,207 A 2/1980 Fienhold et al.
4,191,332 A 3/1980 De Langis et al.
4,203,550 A 5/1980 On
4,209,132 A 6/1980 Kwan
D255,626 S 7/1980 Grube
4,219,160 A 8/1980 Allred, Jr.
4,221,338 A 9/1980 Shames et al.
4,239,409 A 12/1980 Osrow
4,243,253 A 1/1981 Rogers, Jr.
4,244,526 A 1/1981 Arth
D258,677 S 3/1981 Larsson
4,254,914 A 3/1981 Shames et al.
4,258,414 A 3/1981 Sokol
4,272,022 A 6/1981 Evans
4,274,400 A 6/1981 Baus
4,282,612 A 8/1981 King
D261,300 S 10/1981 Klose
D261,417 S 10/1981 Klose
4,303,201 A 12/1981 Elkins et al.
4,319,608 A 3/1982 Raikov et al.
4,330,089 A 5/1982 Finkbeiner
D266,212 S 9/1982 Haug et al.
4,350,298 A 9/1982 Tada
4,353,508 A 10/1982 Butterfield et al.
4,358,056 A 11/1982 Greenhut et al.
D267,582 S 1/1983 Mackay et al.
D268,359 S 3/1983 Klose
D268,442 S 3/1983 Darmon
D268,611 S 4/1983 Klose
4,383,554 A 5/1983 Merriman
4,396,797 A 8/1983 Sakuragi et al.
4,398,669 A 8/1983 Fienhold
4,425,965 A 1/1984 Bayh, III et al.
4,432,392 A 2/1984 Paley
D274,457 S 6/1984 Haug
4,461,052 A 7/1984 Mostul
4,465,308 A 8/1984 Martini
4,467,964 A 8/1984 Kaeser
4,495,550 A 1/1985 Visciano
4,527,745 A 7/1985 Butterfield et al.
4,540,202 A 9/1985 Amphoux et al.
4,545,081 A 10/1985 Nestor et al.
4,553,775 A 11/1985 Halling
D281,820 S 12/1985 Oba et al.
4,561,593 A 12/1985 Cammack et al.
4,564,889 A 1/1986 Bolson
4,571,003 A 2/1986 Roling et al.
4,572,232 A 2/1986 Gruber
D283,645 S 4/1986 Tanaka
4,587,991 A 5/1986 Chorkey
4,588,130 A 5/1986 Trenary et al.
4,598,866 A 7/1986 Cammack et al.
4,614,303 A 9/1986 Moseley, Jr. et al.
4,616,298 A 10/1986 Bolson
4,618,100 A 10/1986 White et al.
4,629,124 A 12/1986 Gruber
4,629,125 A 12/1986 Liu
4,643,463 A 2/1987 Halling et al.
4,645,244 A 2/1987 Curtis
RE32,386 E 3/1987 Hunter
4,650,120 A 3/1987 Kress
4,650,470 A 3/1987 Epstein
4,652,025 A 3/1987 Conroy, Sr.
4,654,900 A 4/1987 McGhee
4,657,185 A 4/1987 Rundzaitis
4,669,666 A 6/1987 Finkbeiner
4,669,757 A 6/1987 Bartholomew
4,674,687 A 6/1987 Smith et al.
4,683,917 A 8/1987 Bartholomew
4,703,893 A 11/1987 Gruber
4,717,180 A 1/1988 Roman
4,719,654 A 1/1988 Blessing
4,733,337 A 3/1988 Bieberstein
D295,437 S 4/1988 Fabian
4,739,801 A 4/1988 Kimura et al.
4,749,126 A 6/1988 Kessener et al.
D296,582 S 7/1988 Haug et al.
4,754,928 A 7/1988 Rogers et al.
D297,160 S 8/1988 Robbins
4,764,047 A 8/1988 Johnston et al.
4,778,104 A 10/1988 Fisher
4,787,591 A 11/1988 Villacorta
4,790,294 A 12/1988 Allred, III et al.
4,801,091 A 1/1989 Sandvik
4,809,369 A 3/1989 Bowden
4,839,599 A 6/1989 Fischer
4,842,059 A 6/1989 Tomek
D302,325 S 7/1989 Charet et al.
4,850,616 A 7/1989 Pava
4,854,499 A 8/1989 Neuman
4,856,822 A 8/1989 Parker
4,865,362 A 9/1989 Holden
D303,830 S 10/1989 Ramsey et al.
4,871,196 A 10/1989 Kingsford
4,896,658 A 1/1990 Yonekubo et al.
D306,351 S 2/1990 Charet et al.
4,901,927 A 2/1990 Valdivia
4,903,178 A 2/1990 Englot et al.
4,903,897 A 2/1990 Hayes
4,903,922 A 2/1990 Harris, III
4,907,137 A 3/1990 Schladitz et al.
4,907,744 A 3/1990 Jousson
4,909,435 A 3/1990 Kidouchi et al.
4,914,759 A 4/1990 Goff
4,946,202 A 8/1990 Perricone
4,951,329 A 8/1990 Shaw
4,953,585 A 9/1990 Rollini et al.
4,964,573 A 10/1990 Lipski
4,972,048 A 11/1990 Martin
D313,267 S 12/1990 Lenci et al.
4,976,460 A 12/1990 Newcombe et al.
D314,246 S 1/1991 Bache
D315,191 S 3/1991 Mikol
4,998,673 A 3/1991 Pilolla
5,004,158 A 4/1991 Halem et al.
D317,348 S 6/1991 Geneve et al.
5,020,570 A 6/1991 Cotter
5,022,103 A 6/1991 Faist
5,032,015 A 7/1991 Christianson
5,033,528 A 7/1991 Volcani
5,033,897 A 7/1991 Chen D319,294 S 8/1991 Kohler, Jr. et al.
D320,064 S 9/1991 Presman
5,046,764 A 9/1991 Kimura et al.
D321,062 S 10/1991 Bonbright
5,058,804 A 10/1991 Yonekubo et al.
D322,119 S 12/1991 Haug et al.
D322,681 S 12/1991 Yuen
5,070,552 A 12/1991 Gentry et al.
D323,545 S 1/1992 Ward
5,082,019 A 1/1992 Tetrault
5,086,878 A 2/1992 Swift
5,090,624 A 2/1992 Rogers
5,100,055 A 3/1992 Rokitenetz et al.
D325,769 S 4/1992 Haug et al.
D325,770 S 4/1992 Haug et al.
5,103,384 A 4/1992 Drohan
D326,311 S 5/1992 Lenci et al.
D327,115 S 6/1992 Rogers
5,121,511 A 6/1992 Sakamoto et al.
D327,729 S 7/1992 Rogers
5,127,580 A 7/1992 Fu-I
5,134,251 A 7/1992 Martin
D328,944 S 8/1992 Robbins
5,141,016 A 8/1992 Nowicki
D329,504 S 9/1992 Yuen
5,143,300 A 9/1992 Cutler
5,145,114 A 9/1992 Monch
5,148,556 A 9/1992 Bottoms et al.
D330,068 S 10/1992 Haug et al.
D330,408 S 10/1992 Thacker
D330,409 S 10/1992 Raffo
5,153,976 A 10/1992 Benchaar et al.
5,154,355 A 10/1992 Gonzalez
5,154,483 A 10/1992 Zeller
5,161,567 A 11/1992 Humpert
5,163,752 A 11/1992 Copeland et al.
5,171,429 A 12/1992 Yasuo
5,172,860 A 12/1992 Yuch
5,172,862 A 12/1992 Heimann et al.
5,172,866 A 12/1992 Ward
D332,303 S 1/1993 Klose
D332,994 S 2/1993 Huen
D333,339 S 2/1993 Klose
5,197,767 A 3/1993 Kimura et al.
D334,794 S 4/1993 Klose
D335,171 S 4/1993 Lenci et al.
5,201,468 A 4/1993 Freier et al.
5,206,963 A 5/1993 Wiens
5,207,499 A 5/1993 Vajda et al.
5,213,267 A 5/1993 Heimann et al.
5,220,697 A 6/1993 Birchfield
D337,839 S 7/1993 Zeller
5,228,625 A 7/1993 Grassberger
5,230,106 A 7/1993 Henkin et al.
D338,542 S 8/1993 Yuen
5,232,162 A 8/1993 Chih
D339,492 S 9/1993 Klose
D339,627 S 9/1993 Klose
D339,848 S 9/1993 Gottwald
5,246,169 A 9/1993 Heimann et al.
5,246,301 A 9/1993 Hirasawa
D340,376 S 10/1993 Klose
5,253,670 A 10/1993 Perrott
5,253,807 A 10/1993 Newbegin
5,254,809 A 10/1993 Martin
D341,007 S 11/1993 Haug et al.
D341,191 S 11/1993 Klose
D341,220 S 11/1993 Eagan
5,263,646 A 11/1993 McCauley
5,265,833 A 11/1993 Heimann et al.
5,268,826 A 12/1993 Greene
5,276,596 A 1/1994 Krenzel
5,277,391 A 1/1994 Haug et al.
5,286,071 A 2/1994 Storage
5,288,110 A 2/1994 Allread
5,294,054 A 3/1994 Benedict et al.
5,297,735 A 3/1994 Heimann et al.
5,297,739 A 3/1994 Allen
D345,811 S 4/1994 Van Deursen et al.
D346,426 S 4/1994 Warshawsky
D346,428 S 4/1994 Warshawsky
D346,430 S 4/1994 Warshawsky
D347,262 S 5/1994 Black et al.
D347,265 S 5/1994 Gottwald
5,316,216 A 5/1994 Cammack et al.
D348,720 S 7/1994 Haug et al.
5,329,650 A 7/1994 Zaccai et al.
D349,947 S 8/1994 Hing-Wah
5,333,787 A 8/1994 Smith et al.
5,333,789 A 8/1994 Garneys
5,340,064 A 8/1994 Heimann et al.
5,340,165 A 8/1994 Sheppard
D350,808 S 9/1994 Warshawsky
5,344,080 A 9/1994 Matsui
5,349,987 A 9/1994 Shieh
5,356,076 A 10/1994 Bishop
5,356,077 A 10/1994 Shames
D352,092 S 11/1994 Warshawsky
D352,347 S 11/1994 Dannenberg
D352,766 S 11/1994 Hill et al.
5,368,235 A 11/1994 Drozdoff et al.
5,369,556 A 11/1994 Zeller
5,370,427 A 12/1994 Hoelle et al.
5,385,500 A 1/1995 Schmidt
D355,242 S 2/1995 Warshawsky
D355,703 S 2/1995 Duell
D356,626 S 3/1995 Wang
5,397,064 A 3/1995 Heitzman
5,398,872 A 3/1995 Joubran
5,398,977 A 3/1995 Berger et al.
5,402,812 A 4/1995 Moineau et al.
5,405,089 A 4/1995 Heimann et al.
5,414,879 A 5/1995 Hiraishi et al.
5,423,348 A 6/1995 Jezek et al.
5,433,384 A 7/1995 Chan et al.
D361,399 S 8/1995 Carbone et al.
D361,623 S 8/1995 Huen
5,441,075 A 8/1995 Clare
5,449,206 A 9/1995 Lockwood
D363,360 S 10/1995 Santarsiero
5,454,809 A 10/1995 Janssen
5,468,057 A 11/1995 Megerle et al.
D364,935 S 12/1995 deBlois
D365,625 S 12/1995 Bova
D365,646 S 12/1995 deBlois
5,476,225 A 12/1995 Chan
D366,309 S 1/1996 Huang
D366,707 S 1/1996 Kaiser
D366,708 S 1/1996 Santarsiero
D366,709 S 1/1996 Szymanski
D366,710 S 1/1996 Szymanski
5,481,765 A 1/1996 Wang
D366,948 S 2/1996 Carbone
D367,315 S 2/1996 Andrus
D367,333 S 2/1996 Swyst
D367,696 S 3/1996 Andrus
D367,934 S 3/1996 Carbone
D368,146 S 3/1996 Carbone
D368,317 S 3/1996 Swyst
5,499,767 A 3/1996 Morand
D368,539 S 4/1996 Carbone et al.
D368,540 S 4/1996 Santarsiero
D368,541 S 4/1996 Kaiser et al.
D368,542 S 4/1996 deBlois et al.
D369,204 S 4/1996 Andrus
D369,205 S 4/1996 Andrus
5,507,436 A 4/1996 Ruttenberg
D369,873 S 5/1996 deBlois et al.
D369,874 S 5/1996 Santarsiero
D369,875 S 5/1996 Carbone
D370,052 S 5/1996 Chan et al.
D370,250 S 5/1996 Fawcett et al.
D370,277 S 5/1996 Kaiser
D370,278 S 5/1996 Nolan
D370,279 S 5/1996 deBlois
D370,280 S 5/1996 Kaiser
D370,281 S 5/1996 Johnstone et al.
5,517,392 A 5/1996 Rousso et al.

5,521,803 A 5/1996 Eckert et al.
D370,542 S 6/1996 Santarsiero
D370,735 S 6/1996 deBlois
D370,987 S 6/1996 Santarsiero
D370,988 S 6/1996 Santarsiero
D371,448 S 7/1996 Santarsiero
D371,618 S 7/1996 Nolan
D371,619 S 7/1996 Szymanski
D371,856 S 7/1996 Carbone
D372,318 S 7/1996 Szymanski
D372,319 S 7/1996 Carbone
5,531,625 A 7/1996 Zhong
5,539,624 A 7/1996 Dougherty
D372,548 S 8/1996 Carbone
D372,998 S 8/1996 Carbone
D373,210 S 8/1996 Santarsiero
D373,434 S 9/1996 Nolan
D373,435 S 9/1996 Nolan
D373,645 S 9/1996 Johnstone et al.
D373,646 S 9/1996 Szymanski et al.
D373,647 S 9/1996 Kaiser
D373,648 S 9/1996 Kaiser
D373,649 S 9/1996 Carbone
D373,651 S 9/1996 Szymanski
D373,652 S 9/1996 Kaiser
5,551,637 A 9/1996 Lo
5,552,973 A 9/1996 Hsu
5,558,278 A 9/1996 Gallorini
D374,271 S 10/1996 Fleischmann
D374,297 S 10/1996 Kaiser
D374,298 S 10/1996 Swyst
D374,299 S 10/1996 Carbone
D374,493 S 10/1996 Szymanski
D374,494 S 10/1996 Santarsiero
D374,732 S 10/1996 Kaiser
D374,733 S 10/1996 Santasiero
5,560,548 A 10/1996 Mueller et al.
5,567,115 A 10/1996 Carbone
D375,541 S 11/1996 Michaluk
5,577,664 A 11/1996 Heitzman
D376,217 S 12/1996 Kaiser
D376,860 S 12/1996 Santarsiero
D376,861 S 12/1996 Johnstone et al.
D376,862 S 12/1996 Carbone
5,605,173 A 2/1997 Arnaud
D378,401 S 3/1997 Neufeld et al.
5,613,638 A 3/1997 Blessing
5,613,639 A 3/1997 Storm et al.
5,615,837 A 4/1997 Roman
5,624,074 A 4/1997 Parisi
5,624,498 A 4/1997 Lee et al.
D379,212 S 5/1997 Chan
D379,404 S 5/1997 Spelts
5,632,049 A 5/1997 Chen
D381,405 S 7/1997 Waidele et al.
D381,737 S 7/1997 Chan
D382,936 S 8/1997 Shfaram
5,653,260 A 8/1997 Huber
5,667,146 A 9/1997 Pimentel et al.
D385,332 S 10/1997 Andrus
D385,333 S 10/1997 Caroen et al.
D385,334 S 10/1997 Caroen et al.
D385,616 S 10/1997 Dow et al.
D385,947 S 11/1997 Dow et al.
D387,230 S 12/1997 von Buelow et al.
5,697,557 A 12/1997 Blessing et al.
5,699,964 A 12/1997 Bergmann et al.
5,702,057 A 12/1997 Huber
D389,558 S 1/1998 Andrus
5,704,080 A 1/1998 Kuhne
5,707,011 A 1/1998 Bosio
5,718,380 A 2/1998 Schorn et al.
D392,369 S 3/1998 Chan
5,730,361 A 3/1998 Thonnes
5,730,362 A 3/1998 Cordes
5,730,363 A 3/1998 Kress
5,742,961 A 4/1998 Casperson et al.
D394,490 S 5/1998 Andrus et al.
5,746,375 A 5/1998 Guo
5,749,552 A 5/1998 Fan
5,749,602 A 5/1998 Delaney et al.
D394,899 S 6/1998 Caroen et al.
D395,074 S 6/1998 Neibrook et al.
D395,142 S 6/1998 Neibrook
5,764,760 A 6/1998 Grandbert et al.
5,765,760 A 6/1998 Kuo
5,769,802 A 6/1998 Wang
5,772,120 A 6/1998 Huber
5,778,939 A 7/1998 Hok-Yin
5,788,157 A 8/1998 Kress
D398,370 S 9/1998 Purdy
5,806,771 A 9/1998 Loschelder et al.
5,819,791 A 10/1998 Chronister et al.
5,820,574 A 10/1998 Henkin et al.
5,823,431 A 10/1998 Pierce
5,823,442 A 10/1998 Guo
5,826,803 A 10/1998 Cooper
5,833,138 A 11/1998 Crane et al.
5,839,666 A 11/1998 Heimann et al.
D402,350 S 12/1998 Andrus
D403,754 S 1/1999 Gottwald
D404,116 S 1/1999 Bosio
5,855,348 A 1/1999 Fornara
5,860,599 A 1/1999 Lin
5,862,543 A 1/1999 Reynoso et al.
5,862,985 A 1/1999 Neibrook et al.
D405,502 S 2/1999 Tse
5,865,375 A 2/1999 Hsu
5,865,378 A 2/1999 Hollinshead et al.
5,873,647 A 2/1999 Kurtz et al.
D408,893 S 4/1999 Tse
D409,276 S 5/1999 Ratzlaff
D410,276 S 5/1999 Ben-Tsur
5,918,809 A 7/1999 Simmons
5,918,811 A 7/1999 Denham et al.
D413,157 S 8/1999 Ratzlaff
5,937,905 A 8/1999 Santos
5,938,123 A 8/1999 Heitzman
5,941,462 A 8/1999 Sandor
5,947,388 A 9/1999 Woodruff
D415,247 S 10/1999 Haverstraw et al.
5,961,046 A 10/1999 Joubran
5,967,417 A 10/1999 Mantel
5,979,776 A 11/1999 Williams
5,992,762 A 11/1999 Wang
D418,200 S 12/1999 Ben-Tsur
5,997,047 A 12/1999 Pimentel et al.
6,003,165 A 12/1999 Loyd
D418,902 S 1/2000 Haverstraw et al.
D418,903 S 1/2000 Haverstraw et al.
D418,904 S 1/2000 Milrud
D421,099 S 2/2000 Mullenmeister
6,021,960 A 2/2000 Kehat
D422,053 S 3/2000 Brenner et al.
6,042,027 A 3/2000 Sandvik
6,042,155 A 3/2000 Lockwood
D422,336 S 4/2000 Haverstraw et al.
D422,337 S 4/2000 Chan
D423,083 S 4/2000 Haug et al.
D423,110 S 4/2000 Cipkowski
D424,160 S 5/2000 Haug et al.
D424,161 S 5/2000 Haug et al.
D424,162 S 5/2000 Haug et al.
D424,163 S 5/2000 Haug et al.
D426,290 S 6/2000 Haug et al.
D427,661 S 7/2000 Haverstraw et al.
D428,110 S 7/2000 Haug et al.
D428,125 S 7/2000 Chan
6,085,780 A 7/2000 Morris
D430,267 S 8/2000 Milrud et al.
6,095,801 A 8/2000 Spiewak
D430,643 S 9/2000 Tse
6,113,002 A 9/2000 Finkbeiner
6,123,272 A 9/2000 Havican et al.
6,123,308 A 9/2000 Faisst
D432,624 S 10/2000 Chan
D432,625 S 10/2000 Chan
D433,096 S 10/2000 Tse D433,097 S 10/2000 Tse
6,126,091 A 10/2000 Heitzman
6,126,290 A 10/2000 Veigel
D434,109 S 11/2000 Ko
6,164,569 A 12/2000 Hollinshead et al.
6,164,570 A 12/2000 Smeltzer
D435,889 S 1/2001 Ben-Tsur et al.
D439,305 S 3/2001 Slothower
6,199,580 B1 3/2001 Morris
6,202,679 B1 3/2001 Titus
D440,276 S 4/2001 Slothower
D440,277 S 4/2001 Slothower
D440,278 S 4/2001 Slothower
D441,059 S 4/2001 Fleischmann
6,209,799 B1 4/2001 Finkbeiner
D443,025 S 5/2001 Kollmann et al.
D443,026 S 5/2001 Kollmann et al.
D443,027 S 5/2001 Kollmann et al.
D443,029 S 5/2001 Kollmann et al.
6,223,998 B1 5/2001 Heitzman
6,230,984 B1 5/2001 Jager
6,230,988 B1 5/2001 Chao et al.
6,230,989 B1 5/2001 Haverstraw et al.
D443,335 S 6/2001 Andrus
D443,336 S 6/2001 Kollmann et al.
D443,347 S 6/2001 Gottwald
6,241,166 B1 6/2001 Overington et al.
6,250,572 B1 6/2001 Chen
D444,865 S 7/2001 Gottwald
D445,871 S 7/2001 Fan
6,254,014 B1 7/2001 Clearman et al.
6,270,278 B1 8/2001 Mauro
6,276,004 B1 8/2001 Bertrand et al.
6,283,447 B1 9/2001 Fleet
6,286,764 B1 9/2001 Garvey et al.
D449,673 S 10/2001 Kollmann et al.
D450,370 S 11/2001 Wales et al.
D450,805 S 11/2001 Lindholm et al.
D450,806 S 11/2001 Lindholm et al.
D450,807 S 11/2001 Lindholm et al.
D451,169 S 11/2001 Lindholm et al.
D451,170 S 11/2001 Lindholm et al.
D451,171 S 11/2001 Lindholm et al.
D451,172 S 11/2001 Lindholm et al.
6,321,777 B1 11/2001 Wu
6,322,006 B1 11/2001 Guo
D451,583 S 12/2001 Lindholm et al.
D451,980 S 12/2001 Lindholm et al.
D452,553 S 12/2001 Lindholm et al.
D452,725 S 1/2002 Lindholm et al.
D452,897 S 1/2002 Gillette et al.
6,336,764 B1 1/2002 Liu
D453,369 S 2/2002 Lobermeier
D453,370 S 2/2002 Lindholm et al.
D453,551 S 2/2002 Lindholm et al.
6,349,735 B2 2/2002 Gul
D454,617 S 3/2002 Curbbun et al.
D454,938 S 3/2002 Lord
6,375,342 B1 4/2002 Koren et al.
D457,937 S 5/2002 Lindholm et al.
6,382,531 B1 5/2002 Tracy
D458,348 S 6/2002 Mullenmeister
6,412,711 B1 7/2002 Fan
D461,224 S 8/2002 Lobermeier
D461,878 S 8/2002 Green et al.
6,450,425 B1 9/2002 Chen
6,454,186 B2 9/2002 Haverstraw et al.
6,463,658 B1 10/2002 Larsson
6,464,265 B1 10/2002 Mikol
D465,552 S 11/2002 Tse
D465,553 S 11/2002 Singtoroj
6,484,952 B2 11/2002 Koren
D468,800 S 1/2003 Tse
D469,165 S 1/2003 Lim
6,502,796 B1 1/2003 Wales
6,508,415 B2 1/2003 Wang
6,511,001 B1 1/2003 Huang
D470,219 S 2/2003 Schweitzer
6,516,070 B2 2/2003 Macey
D471,253 S 3/2003 Tse
D471,953 S 3/2003 Colligan et al.
6,533,194 B2 3/2003 Marsh et al.
6,537,455 B2 3/2003 Farley
D472,958 S 4/2003 Ouyoung
6,550,697 B2 4/2003 Lai
6,585,174 B1 7/2003 Huang
6,595,439 B1 7/2003 Chen
6,607,148 B1 8/2003 Marsh et al.
6,611,971 B1 9/2003 Antoniello et al.
6,637,676 B2 10/2003 Zieger et al.
6,641,057 B2 11/2003 Thomas et al.
D483,837 S 12/2003 Fan
6,659,117 B2 12/2003 Gilmore
6,659,372 B2 12/2003 Marsh et al.
D485,887 S 1/2004 Luettgen et al.
D486,888 S 2/2004 Lobermeier
6,691,338 B2 2/2004 Zieger
6,691,933 B1 2/2004 Bosio
D487,301 S 3/2004 Haug et al.
D487,498 S 3/2004 Blomstrom
6,701,953 B2 3/2004 Agosta
6,715,699 B1 4/2004 Greenberg et al.
6,719,218 B2 4/2004 Cool et al.
D489,798 S 5/2004 Hunt
D490,498 S 5/2004 Golichowski
6,736,336 B2 5/2004 Wong
6,739,523 B2 5/2004 Haverstraw et al.
6,739,527 B1 5/2004 Chung
D492,004 S 6/2004 Haug et al.
D492,007 S 6/2004 Kollmann et al.
6,742,725 B1 6/2004 Fan
D493,208 S 7/2004 Lin
D493,864 S 8/2004 Haug et al.
D494,655 S 8/2004 Lin
D494,661 S 8/2004 Zieger et al.
D495,027 S 8/2004 Mazzola
6,776,357 B1 8/2004 Naito
6,789,751 B1 9/2004 Fan
D496,987 S 10/2004 Glunk
D497,974 S 11/2004 Haug et al.
D498,514 S 11/2004 Haug et al.
D500,121 S 12/2004 Blomstrom
D500,549 S 1/2005 Blomstrom
D501,242 S 1/2005 Blomstrom
D502,760 S 3/2005 Zieger et al.
D502,761 S 3/2005 Zieger et al.
D503,211 S 3/2005 Lin
6,863,227 B2 3/2005 Wollenberg et al.
6,869,030 B2 3/2005 Blessing et al.
D503,774 S 4/2005 Zieger
D503,775 S 4/2005 Zieger
D503,966 S 4/2005 Zieger
6,899,292 B2 5/2005 Titinet
D506,243 S 6/2005 Wu
D507,037 S 7/2005 Wu
6,935,581 B2 8/2005 Titinet
D509,280 S 9/2005 Bailey et al.
D509,563 S 9/2005 Bailey et al.
D510,123 S 9/2005 Tsai
D511,809 S 11/2005 Haug et al.
D512,119 S 11/2005 Haug et al.
6,981,661 B1 1/2006 Chen
D516,169 S 2/2006 Wu
7,000,854 B2 2/2006 Malek et al.
7,004,409 B2 2/2006 Okubo
7,004,410 B2 2/2006 Li
D520,109 S 5/2006 Wu
7,040,554 B2 5/2006 Drennow
7,048,210 B2 5/2006 Clark
7,055,767 B1 6/2006 Ko
7,070,125 B2 7/2006 Williams et al.
7,077,342 B2 7/2006 Lee
D527,440 S 8/2006 Macan
7,093,780 B1 8/2006 Chung
7,097,122 B1 8/2006 Farley
D528,631 S 9/2006 Gillette et al.
7,100,845 B1 9/2006 Hsieh
7,111,795 B2 9/2006 Thong

| | | | |
|---|---|---|---|
| 7,111,798 | B2 | 9/2006 | Thomas et al. |
| D530,389 | S | 10/2006 | Genslak et al. |
| D530,392 | S | 10/2006 | Tse |
| D531,259 | S | 10/2006 | Hsieh |
| 7,114,666 | B2 | 10/2006 | Luettgen et al. |
| D533,253 | S | 12/2006 | Luettgen et al. |
| D534,239 | S | 12/2006 | Dingler et al. |
| D535,354 | S | 1/2007 | Wu |
| D536,060 | S | 1/2007 | Sadler |
| 7,156,325 | B1 | 1/2007 | Chen |
| D538,391 | S | 3/2007 | Mazzola |
| D540,424 | S | 4/2007 | Kirar |
| D540,425 | S | 4/2007 | Endo et al. |
| D540,426 | S | 4/2007 | Cropelli |
| D540,427 | S | 4/2007 | Bouroullec et al. |
| D542,391 | S | 5/2007 | Gilbert |
| D542,393 | S | 5/2007 | Haug et al. |
| 7,229,031 | B2 | 6/2007 | Schmidt |
| 7,243,863 | B2 | 7/2007 | Glunk |
| 7,246,760 | B2 | 7/2007 | Marty et al. |
| D552,713 | S | 10/2007 | Rexach |
| 7,278,591 | B2 | 10/2007 | Clearman et al. |
| D556,295 | S | 11/2007 | Genord et al. |
| 7,299,510 | B2 | 11/2007 | Tsai |
| D557,763 | S | 12/2007 | Schonherr et al. |
| D557,764 | S | 12/2007 | Schonherr et al. |
| D557,765 | S | 12/2007 | Schonherr et al. |
| D558,301 | S | 12/2007 | Hoernig et al. |
| 7,303,151 | B2 | 12/2007 | Wu |
| D559,357 | S | 1/2008 | Wang et al. |
| D559,945 | S | 1/2008 | Patterson et al. |
| D560,269 | S | 1/2008 | Tse et al. |
| D562,937 | S | 2/2008 | Schonherr et al. |
| D562,938 | S | 2/2008 | Blessing |
| D562,941 | S | 2/2008 | Pan |
| 7,331,536 | B1 | 2/2008 | Zhen et al. |
| 7,347,388 | B2 | 3/2008 | Chung |
| D565,699 | S | 4/2008 | Berberet |
| D565,702 | S | 4/2008 | Daunter et al. |
| D565,703 | S | 4/2008 | Lammel et al. |
| D566,228 | S | 4/2008 | Neagoe |
| D566,229 | S | 4/2008 | Rexach |
| D567,328 | S | 4/2008 | Spangler et al. |
| 7,360,723 | B2 | 4/2008 | Lev |
| 7,364,097 | B2 | 4/2008 | Okuma |
| 7,374,112 | B1 | 5/2008 | Bulan et al. |
| 7,384,007 | B2 | 6/2008 | Ho |
| D577,099 | S | 9/2008 | Leber |
| D577,793 | S | 9/2008 | Leber |
| D580,012 | S | 11/2008 | Quinn et al. |
| D580,513 | S | 11/2008 | Quinn et al. |
| D581,013 | S | 11/2008 | Citterio |
| D581,014 | S | 11/2008 | Quinn et al. |
| 7,503,345 | B2 | 3/2009 | Paterson et al. |
| D590,048 | S | 4/2009 | Leber et al. |
| 7,520,448 | B2 | 4/2009 | Luettgen et al. |
| D592,276 | S | 5/2009 | Schoenherr et al. |
| D592,278 | S | 5/2009 | Leber |
| 7,537,175 | B2 | 5/2009 | Miura et al. |
| D600,777 | S | 9/2009 | Whitaker et al. |
| D608,412 | S | 1/2010 | Barnard et al. |
| D608,413 | S | 1/2010 | Barnard et al. |
| D616,061 | S | 5/2010 | Whitaker et al. |
| D621,904 | S | 8/2010 | Yoo et al. |
| D621,905 | S | 8/2010 | Yoo et al. |
| 7,832,662 | B2 | 11/2010 | Gallo |
| D628,676 | S | 12/2010 | Lee |
| D629,867 | S | 12/2010 | Rexach et al. |
| D641,831 | S | 7/2011 | Williams |
| 2003/0062426 | A1 | 4/2003 | Gregory et al. |
| 2004/0118949 | A1 | 6/2004 | Marks |
| 2004/0244105 | A1 | 12/2004 | Tsai |
| 2005/0001072 | A1 | 1/2005 | Bolus et al. |
| 2005/0284967 | A1 | 12/2005 | Korb |
| 2006/0016908 | A1 | 1/2006 | Chung |
| 2006/0016913 | A1 | 1/2006 | Lo |
| 2006/0043214 | A1 | 3/2006 | Macan et al. |
| 2006/0060678 | A1 | 3/2006 | Mazzola |
| 2006/0102747 | A1 | 5/2006 | Ho |
| 2006/0157590 | A1 | 7/2006 | Clearman et al. |
| 2006/0163391 | A1 | 7/2006 | Schorn |
| 2006/0219822 | A1 | 10/2006 | Miller et al. |
| 2006/0283986 | A1 | 12/2006 | Chung |
| 2007/0040054 | A1 | 2/2007 | Farzan |
| 2007/0200013 | A1 | 8/2007 | Hsiao |
| 2007/0246577 | A1 | 10/2007 | Leber |
| 2007/0252021 | A1 | 11/2007 | Cristina |
| 2007/0272770 | A1 | 11/2007 | Leber et al. |
| 2008/0073449 | A1 | 3/2008 | Haynes et al. |
| 2008/0083844 | A1 | 4/2008 | Leber et al. |
| 2008/0111004 | A1 | 5/2008 | Huffman |
| 2008/0121293 | A1 | 5/2008 | Leber |
| 2008/0156897 | A1 | 7/2008 | Leber |
| 2008/0156902 | A1 | 7/2008 | Luettgen et al. |
| 2008/0156903 | A1 | 7/2008 | Leber |
| 2008/0223957 | A1 | 9/2008 | Schorn |
| 2008/0272203 | A1 | 11/2008 | Leber |
| 2008/0272591 | A1 | 11/2008 | Leber |
| 2009/0200404 | A1 | 8/2009 | Cristina |
| 2009/0218420 | A1 | 9/2009 | Mazzola |
| 2009/0307836 | A1 | 12/2009 | Blattner et al. |
| 2010/0320290 | A1 | 12/2010 | Luettgen et al. |
| 2011/0000982 | A1 | 1/2011 | Luettgen et al. |
| 2011/0000983 | A1 | 1/2011 | Chang |
| 2011/0011953 | A1 | 1/2011 | Macan et al. |

FOREIGN PATENT DOCUMENTS

| | | |
|---|---|---|
| CA | 2341041 | 8/1999 |
| CH | 234284 | 3/1963 |
| DE | 352813 | 5/1922 |
| DE | 848627 | 9/1952 |
| DE | 854100 | 10/1952 |
| DE | 2360534 | 6/1974 |
| DE | 2806093 | 8/1979 |
| DE | 3107808 | 9/1982 |
| DE | 3246327 | 6/1984 |
| DE | 3440901 | 7/1985 |
| DE | 3706320 | 3/1988 |
| DE | 8804236 | 6/1988 |
| DE | 4034695 | 5/1991 |
| DE | 19608085 | 9/1996 |
| DE | 202005000881 | 3/2005 |
| DE | 102006032017 | 1/2008 |
| EP | 0167063 | 6/1985 |
| EP | 0478999 | 4/1992 |
| EP | 0514753 | 11/1992 |
| EP | 0435030 | 7/1993 |
| EP | 0617644 | 10/1994 |
| EP | 0683354 | 11/1995 |
| EP | 0687851 | 12/1995 |
| EP | 0695907 | 2/1996 |
| EP | 0700729 | 3/1996 |
| EP | 0719588 | 7/1996 |
| EP | 0721082 | 7/1996 |
| EP | 0733747 | 9/1996 |
| EP | 0808661 | 11/1997 |
| EP | 0726811 | 1/1998 |
| EP | 2164642 | 10/2010 |
| EP | 2260945 | 12/2010 |
| FR | 538538 | 6/1922 |
| FR | 873808 | 7/1942 |
| FR | 1039750 | 10/1953 |
| FR | 1098836 | 8/1955 |
| FR | 2596492 | 10/1987 |
| FR | 2695452 | 3/1994 |
| GB | 3314 | 0/1914 |
| GB | 10086 | 0/1894 |
| GB | 129812 | 7/1919 |
| GB | 204600 | 10/1923 |
| GB | 634483 | 3/1950 |
| GB | 971866 | 10/1964 |
| GB | 1111126 | 4/1968 |
| GB | 2066074 | 1/1980 |
| GB | 2066704 | 7/1981 |
| GB | 2068778 | 8/1981 |
| GB | 2121319 | 12/1983 |
| GB | 2155984 | 10/1985 |
| GB | 2156932 A | 10/1985 |

| | | |
|---|---|---|
| GB | 2199771 | 7/1988 |
| GB | 2298595 | 11/1996 |
| GB | 2337471 | 11/1999 |
| IT | 327400 | 7/1935 |
| IT | 350359 | 7/1937 |
| IT | 563459 | 5/1957 |
| JP | S63-181459 | 11/1988 |
| JP | H2-78660 | 6/1990 |
| JP | 4062238 | 2/1992 |
| JP | 4146708 | 5/1992 |
| NL | 8902957 | 6/1991 |
| WO | WO93/12894 | 7/1993 |
| WO | WO93/25839 | 12/1993 |
| WO | WO96/00617 | 1/1996 |
| WO | WO98/30336 | 7/1998 |
| WO | WO99/59726 | 11/1999 |
| WO | WO00/10720 | 3/2000 |
| WO | WO2010/004593 | 1/2010 |

SHOWER ASSEMBLY WITH RADIAL MODE CHANGER

CROSS-REFERENCE TO RELATED APPLICATION

This application claims priority to U.S. Provisional Application Ser. No. 61/097,069, filed Sep. 15, 2008, and entitled "Shower Assembly with Radial Mode Changer," which is herein incorporated by reference in its entirety.

TECHNICAL FIELD

The technology disclosed herein relates to shower assemblies having several different spray modes.

BACKGROUND

Multi-function shower heads have a plurality of spray modes, including various standard sprays and pulsed sprays. Typically, the spray mode is selected using a control ring positioned around the circumference of the shower head, and moveable with respect to the shower head. The ring is rotated around the shower head to select the desired spray mode. Several problems result from such shower heads. For example, adjusting the control ring structure often requires the user to handle the control ring across the face of the shower head, thereby interfering with the flow from the shower head and producing undesired splashing. Using the control ring may also cause the orientation of the spray head to be adjusted inadvertently. Additionally, such shower heads require that the shape of the shower head be substantially round, and limit the amount of surface area available on the shower head for spray nozzles Accordingly, a multi-function shower head having a convenient mechanism for selecting spray modes may be provided to address these deficiencies. In addition, a multi-function shower head may allow for flexibility in styling and/or shaping of the shower head. Further, a multi-function shower head may provide an increased surface area available for spray nozzles relative to other shower heads having the same or similar diameter or surface area.

SUMMARY

According to one embodiment, a shower assembly for expelling water is configured with a plurality of spray modes. The shower assembly includes a housing having a water inflow and a water outflow. The shower assembly also includes a manifold defining a cavity having a sidewall. One or more mode apertures are formed or disposed in the sidewall of the cavity, correspond to one of a plurality of spray modes and are in fluid communication with the water outflow. The shower assembly further includes a radial mode changer defining a hollow passageway in fluid communication with the inlet flow path, and further defining a plurality of recessed ports in fluid communication with the hollow passageway. The radial mode changer is rotatably received in the cavity of the manifold such that the radial mode changer may be rotated relative to the manifold to align at least one of the recessed ports with at least one of the mode apertures such that water may flow from the water inflow to the water outflow via the radial mode changer. Thus, different spray modes of the shower assembly may be selected via rotation of the radial mode changer, which receives and directs water flow from a position behind spray passageways from which the water flows out of the shower assembly.

In another embodiment, a radial mode engine is provided for expelling water using a plurality of spray modes. The radial mode engine includes a front channel plate having a manifold formed by an annular wall with a number of mode apertures defined in the annular wall. A number of partitions extend from an exterior of the annular wall and define at least two channels, which each correspond to one of the plurality of spray modes. The mode apertures provide fluid communication between the manifold and the at least two channels, and the channels provide a water outflow of the corresponding spray mode. A rear channel plate couples to the front channel plate and encloses the at least two channels to form at least two chambers. A radial mode changer is received in the annular wall and is formed as cylindrical body, which defines a hollow passageway in fluid communication with a water inflow and defines one or more recessed ports in fluid communication with the hollow passageway. When the radial mode changer is rotated relative to the manifold to align one of the recessed ports with one of the mode apertures, water from the water inflow flows through the radial mode changer into one of the chambers to provide water outflow of the corresponding mode. When the radial mode changer is again rotated relative to the manifold, the one or more of the recessed ports aligns with two of the mode apertures such that water from the water inflow flows through the radial mode changer into two of the chambers to provide water outflow of the two corresponding modes.

In yet another embodiment, a radial mode changer is provided for receiving water inflow and directing water to a spray mode chamber of a showerhead having a plurality of spray mode chambers. The radial mode changer includes a cylindrical body formed of a first cylinder and a second cylinder, which is integrally formed with and concentrically arranged around the first cylinder. The second cylinder is sized with a height that is less than a height of the first cylinder. The first cylinder forms a top recessed portion relative to the second cylinder and the first cylinder forms a hollow passageway for receiving water inflow from the top. The second cylinder includes a first and a second annular recessed port extending radially into the cylindrical body from a side of the second cylinder transverse to the top recessed portion. The first and second recessed ports are fluidly connected to the hollow passageway to form a fluid passageway.

These and other features and advantages of the present disclosure will become apparent to those skilled in the art from the following detailed description, wherein it is shown and described illustrative implementations, including best modes contemplated. As it will be realized, modifications in various obvious aspects may be made, all without departing from the spirit and scope of the present disclosure. Accordingly, the drawings and detailed description are to be regarded as illustrative in nature and not restrictive.

DETAILED DESCRIPTION

A spray controller for providing several different spray modes of standard sprays and pulsed sprays, alone or in combination, to a shower assembly, e.g., a showerhead, a shower bracket for a hand shower, a diverter valve, a shower arm, or other shower combinations, is provided. Various aspects of this technology are described below with reference to the accompanying figures.

Figure 1:
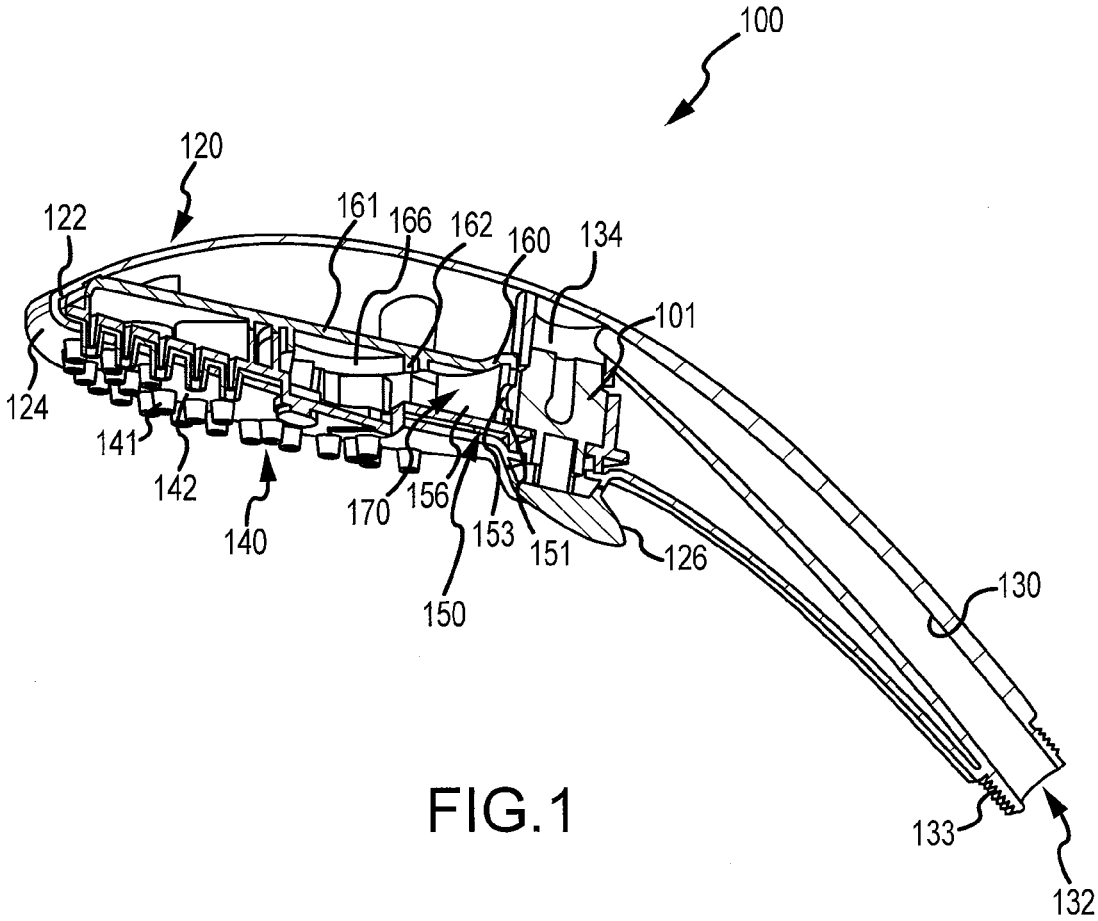
FIG. 1 provides an isometric, cross-sectional view of an exemplary shower assembly according to certain embodiments.

FIG. 1 depicts an isometric cross-sectional view of a shower assembly 100 that includes radial mode changer 101 for providing spray control. Shower assembly 100, in addition to radial mode changer 101, includes housing 120 with water inflow 130 for receiving water from a water source, water outflow 140, front channel plate 150, rear channel plate 160, and chambers 170 defined by the interior wall of front and rear channel plates 150, 160.

According to certain embodiments, radial mode changer 101 may be an arrangement of two concentric cylinders with an inner cylinder defining an opening at a top, which is connected to the water inlet for receiving water from a water source via water inflow 130. Two seals of different sizes defining recessed ports may be funnel shaped and widen from the opening defined in the cylinder and terminate at a side of the cylinder. The fluid passageway defined through the top and side of the concentric cylinders results in water received in the inner cylinder being redirected transverse from the direction the water was received. The water stream entering radial mode changer 101 may optionally be split into two or more paths via the seals, which deliver the stream or streams of water to water outflow 140, where the water exits the shower assembly via one or more spray modes determined by the configuration of interior chamber 170 and the mode selected by a user operating radial mode changer 101.

Housing 120 is configured to enclose radial mode changer 101, and may include an exterior with top surface 122 and bottom surface 124. According to certain implementations, mode changer knob 126 may extend from the external bottom surface 124 of housing 120 and couple to radial mode changer 101, such that rotation of knob 126 slaves and effects rotation of radial mode changer 101, and causes radial mode changer 101 to move among and between one or more spray modes. Operating radial mode changer 101 may thus be simplified because, for example, rotation of changer knob 126 coupled to a radial mode changer 101 is used to effect mode change as opposed to rotation of a component surrounding the entire circumference of the showerhead.

Water inflow 130, for delivering water to radial mode changer 101, may be configured as handle 131 with a hollow tubular interior formed by housing 120. Handle 131 may be coupled to a water source (not shown) by a threaded engagement via threading 132 at receiving end 133 of handle 131. Water inflow 130 may terminate proximate inflow passageway 134, e.g., at or in inflow passageway 134, defined by a cylindrical wall sized and shaped to complement or couple to a top portion of radial mode changer 101. According to the embodiment depicted in FIG. 1, inflow passageway 134 extends axially relative to radial mode changer 101, and inflow passageway 134 is configured as a tubular member that may be sealingly coupled around the exterior walls of radial mode changer 101. The cylindrical walls of inflow passageway 134 may at least partially, and closely, receive a top portion of radial mode changer 101. Configurations of water inflow 130 other than a handle may include conduits leading to inflow passageways formed by showerheads, shower brackets for hand showers, diverter valves, and other showerhead combinations, which may complement or may be configured to feed into the radial mode changer 101.

Water outflow 140 is an arrangement of a series of spray nozzles from which water exits the shower assembly 100. As water exits radial mode changer 101 and passes through front channel plate 150 and rear channel plate 160, the water is delivered from shower assembly 100 via water outflow 140. Water outflow 140 may include nozzles 141 and apertures 142 extending below bottom surface 124 of housing 120. According to certain implementations, nozzles 141 and apertures 142 may be associated with or integral to front channel plate 150.

According to FIG. 1, front channel plate 150 may be configured with manifold 151 arranged between water inflow 130 and water outflow 140, so that manifold 151 is arranged behind an area from which water exits the shower assembly 100. That is, manifold 151 is positioned at a first end of front channel plate 150, while the channels defined by partitions 156 extend or radiate from an outer wall of manifold 151 towards a second end of the front channel plate 150. Manifold 151 is cylindrically sized and shaped such that cylindrical radial mode changer 101 may be at least partially seated in an interior or a cavity of manifold 151. Manifold 151 may include an annular wall extending from a top surface of the front channel plate 150 arranged axially relative to radial mode changer 101. A tubular cavity defined by the annular wall of manifold 151 includes mode apertures 152, 153, and 154 (see FIGS. 3A, 3F, 5A-5C, and 6A-6H) defined by vertically-oriented, annular-shaped walls forming openings arranged in the annular wall of manifold 151. Water exiting radial mode changer 101 passes through one or more mode apertures 152, 153, and 154 (each corresponding to an independent spray mode), into channels defined by sidewalls or partitions 156 in order to deliver water to the water outflow 140.

Rear channel plate 160, according to FIG. 1, includes a first surface 161 for affixing to housing 120 of shower assembly 100, and a second surface 162 configured with a number of vertically arranged sidewalls or partitions 166 sized and shaped to couple with sidewalls or partitions 156 from front channel plate 150 to form continuous chamber walls.

Accordingly, one or more chambers 170 may be formed by coupling sidewalls or partitions 156, 166 of front channel plate 150 and rear channel plate 160. Chambers 170 may be sealed with respect to one another and receive water flow from radial mode changer 101. As water flows into one or more sealed chambers 170, the water is forced through the flow paths formed by the chambers, and exits the output apertures and nozzles configured for a desired spray mode. It will be understood that chambers 170 may be formed by walls of the front and/or rear channel plate 150, 160 and may include sealing structures, for example O-rings, polymeric seals, portions of the channel plate that mate with another channel plate or other structure that include complementary protruding and recessed structures, or recessed structures configured to receive O-rings or polymeric seals, so as to provide a seal between multiple chambers 170 and between the chambers 170 and other portions of shower assembly 100.

FIGS. 2A-2F provide an isometric view, a bottom plan view, a first side elevation view, a second side elevation view, a vertical cross-section view (taken along line 2E-2E in FIG. 2D) and a horizontal cross-section view (taken along line 2F-2F in FIG. 2D), respectively, of the radial mode changer 101, according to certain embodiments.

According to FIGS. 2A-2F, radial mode changer 101 is configured as a generally cylindrical structure of two concentric cylinders, and includes top recessed portion 102 and bottom recessed portion 104 together forming an inner cylinder, which is separated by body portion 106 forming an outer cylinder. First open end 108 defines an entrance to first hollow passageway 110 through the top recessed portion 102 of the inner cylinder and second open end 111 defines an entrance to second hollow passageway 112 (FIG. 2B) through the bottom recessed portion 104, a first recessed port 113 and second recessed port 114 (FIG. 2F) defined in the body portion 106 and fluidly coupled to first hollow passageway 110, cut-out 115 defined in the body portion 106, and slot 116 defined in the bottom recessed portion 104.

Figure 3A:
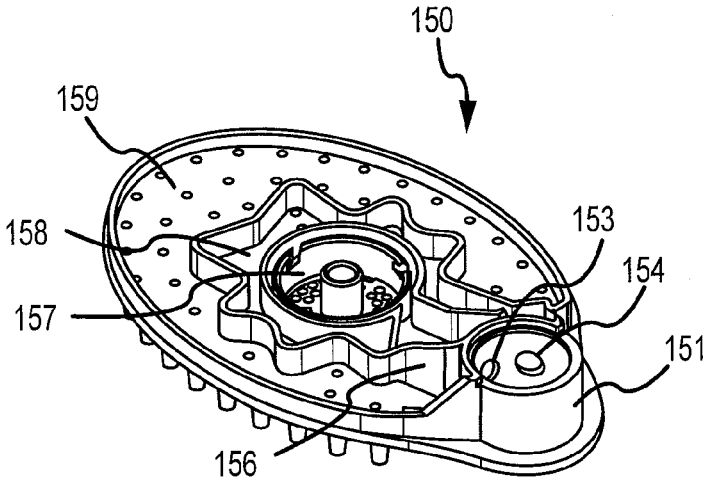
FIGS. 3A-E depict an isometric view, a top plan view, a right side elevation view, a bottom plan view, and a vertical cross-sectional view as indicated in FIG. 3D, respectively, of a front channel plate provided according to certain embodiments.
Figure 3B:
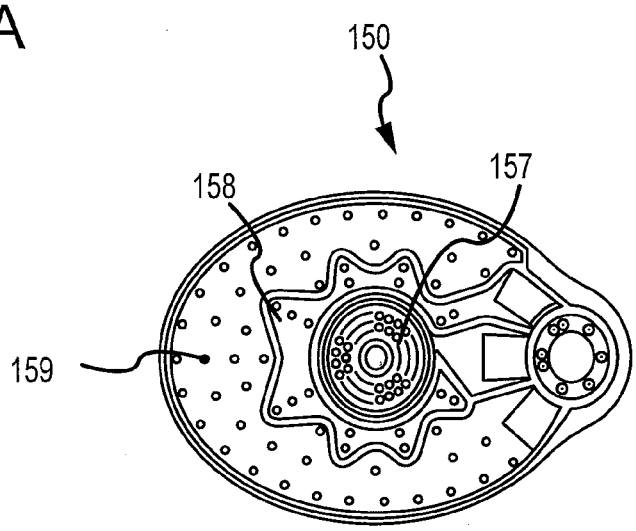
Figure 3C:
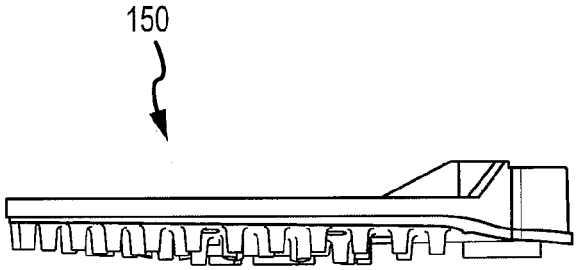
Figure 3D:
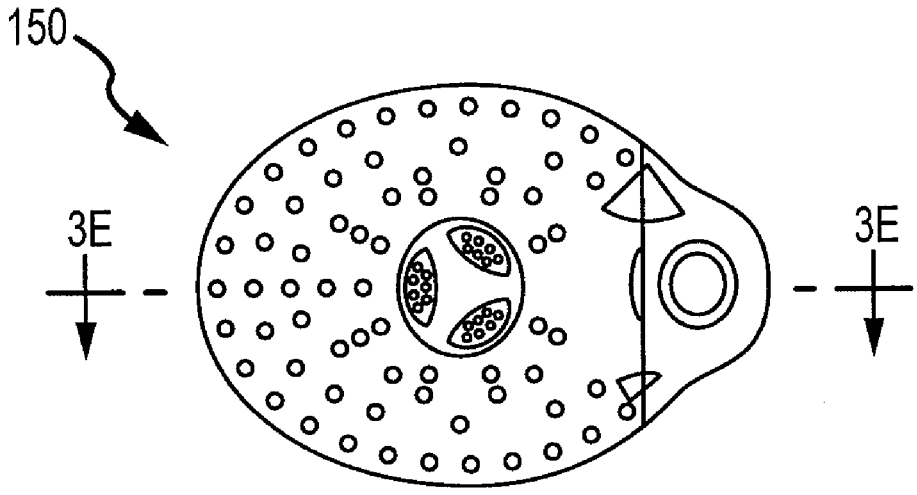
Figure 3E:
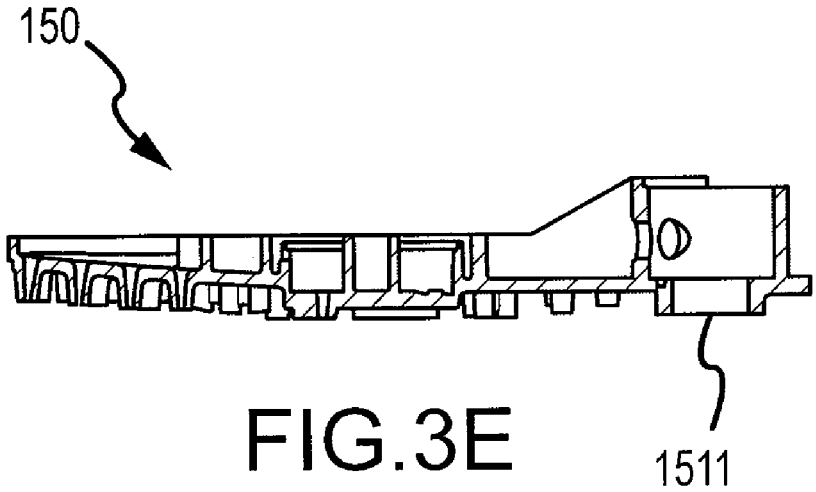

The top recessed portion 102, bottom recessed portion 104, and body portion 106 of radial mode changer 101 may be configured so that each portion may sit in or receive a component of shower assembly 100. According to certain implementations, the body portion 106 is assembled in manifold 151. Such an arrangement provides for the outer wall of body portion 106 to sealingly engage with the inner wall of manifold 151. In this arrangement, at least a portion of top recessed portion 102 extends beyond the annular walls of manifold 151 for receiving inflow passageway 134. Bottom recessed portion 104 may be sized and shaped to extend through and out of front channel plate 150 at an opening 1511 (see FIG. 3E) defined by manifold 151 for receiving a control knob 126. It will be understood that one or more portions of radial mode changer 101 in addition to body portion 106 may also sealingly engage with the various components of the shower assembly 100.

First open end 108 at top recessed portion 102 may also extend above manifold 151. In this configuration, top recessed portion 102, at or near first open end 108, may include one or more sections that are recessed radially such that one or more annular ridges 117 (see FIG. 2D) extend circumferentially about the top recessed portion 102. The annular ridges 117 may be configured to accommodate an O-ring 200 (see FIG. 2J) or a lip seal 201 with V-shaped annular groove 202 (see FIG. 2E) between annular ridges 117. This allows the top recessed portion 102 to sealingly couple to inflow passageway 134.

First hollow passageway 110 arranged at first open end 108 is formed in an inner cylinder of the two concentric cylinders and extends axially into the body portion 106. First hollow passageway 110 is configured to receive water from inflow passageway 134 and to be fluidly coupled to recessed ports 113, 114 defined in the body portion 106. The interconnection between first hollow passageway 110 and recessed ports 113, 114 fluidly couples water inflow 130 to water outflow 140.

Second open end 111 defines an entrance to second hollow passageway 112, which extends axially into bottom recessed portion 104, but terminates before meeting first hollow passageway 110. The second open end 111 extends out of the front channel plate 150 via the opening 1511 defined by manifold 151. By way of slot 116, the second open end 111 may engagingly couple with a mode changer knob 126 (see FIGS. 1 and 5D) extending from the external bottom surface 124 of the housing 120. Accordingly, rotation of the knob 126 effects rotation of the radial mode changer 101 and causes the radial mode changer 101 move among and between one or more spray modes. In order to provide a sealing engagement between bottom recessed portion and the opening 1511, a lip seal 204 (see FIG. 2J) may be provided around a circumference of the bottom recessed portion 104 where manifold 151 receives the bottom recessed portion 104. The arrangement of lip seal 204 adjacent to the second open end may prevent water from entering the shower assembly from the area of the knob 126.

Figure 2A:
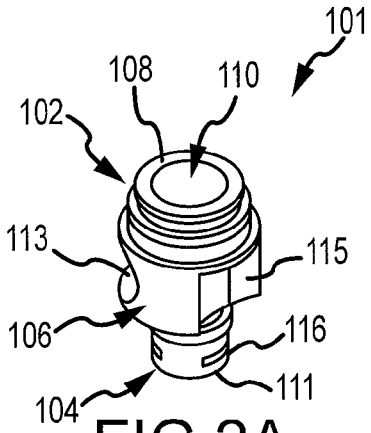
FIGS. 2A-F depict an isometric view, a bottom plan view, a first side elevation view, a second side elevation view, and vertical and horizontal cross-sectional views as indicated in FIG. 2D, respectively, of an embodiment of the radial mode changer provided according to certain implementations.
Figure 2B:
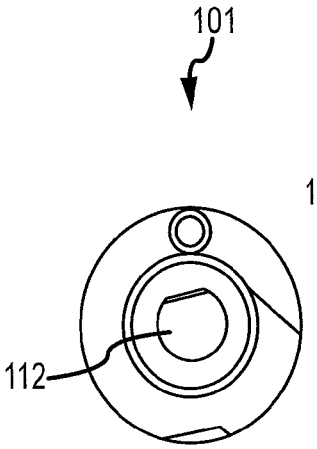
Figure 2C:
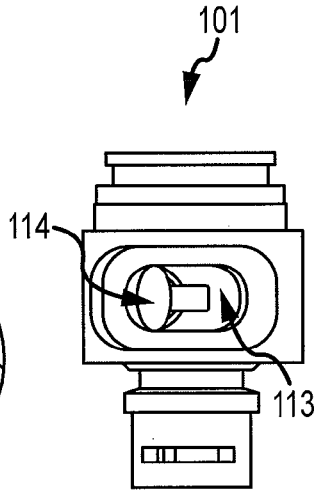
Figure 2D:
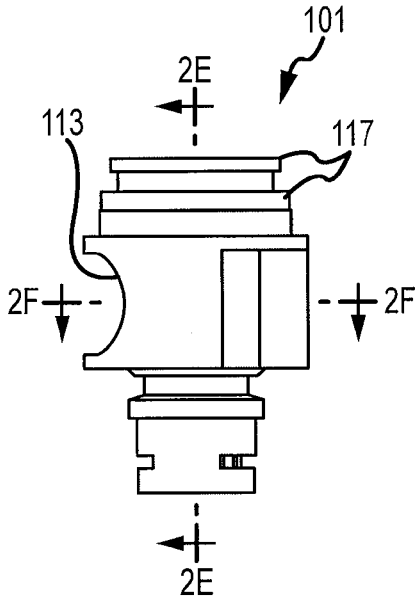
Figure 2E:
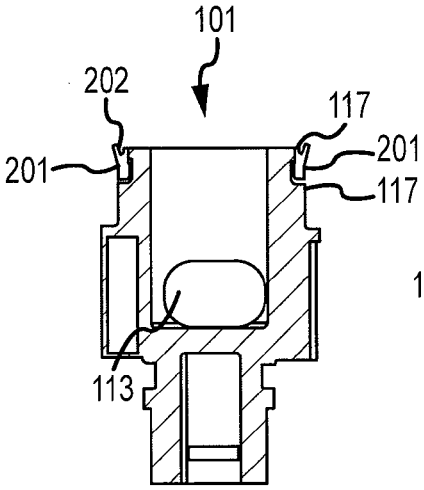
Figure 2F:
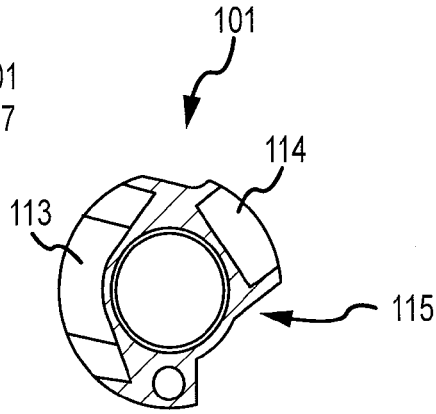

In some embodiments, recessed ports 113, 114 may be formed in the body portion 106 as a cut-out or concave portion defined by walls the body portion 106 and may be radially recessed up to the first hollow passageway 110. Recessed ports 113, 114 may extend axially along all or a portion of the length of the main body portion 106, and may extend longitudinally around a portion of the circumference of the main body portion 106. In certain implementations, first recessed port 113 may extend around the circumference of the body portion 106 a distance greater or less than the distance in which second recessed port 114 extends around the body portion 106. As illustrated in FIG. 2F, first recessed port 113 extends around the circumference of body portion 106 a greater distance than second recessed port 114. In another embodiment, first and second recessed ports 113, 114 may extend circumferentially about the body portion 106 about the same distance. Referring to FIG. 2C, first and second recessed ports 113, 114 may be elliptical. First and second recessed ports 113, 114 may be configured with a shape for facilitating delivery of water to chambers 170. For example, the fluid path between first hollow passageway 110 and first and second recessed ports 113, 114 may expand as it travels radially outward such that the path is generally funnel-shaped. This funnel shape may facilitate directing the water to the apertures in manifold 151. In certain implementations, a number of recessed ports, such as three or more recessed ports, may be defined in body portion 106. According to further embodiments, and as described in the embodiments below, recessed ports may include sealing components to form one or more tightly fitted fluid connections between the radial mode changer and the manifold 151.

Figure 2G:
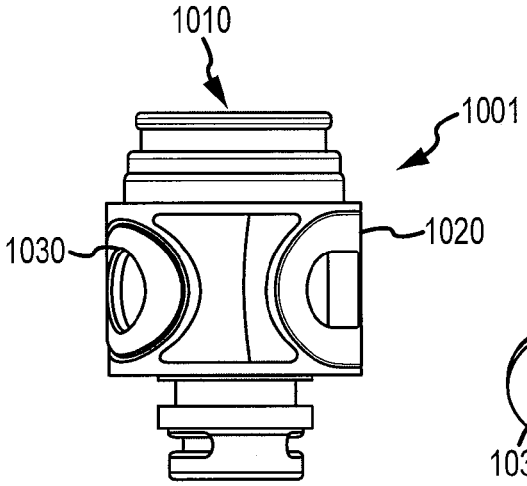
FIGS. 2G-I depict a isometric views, with FIGS. 2H and 2I being exploded views, of another embodiment of a radial mode changer according to alternative implementations.
Figure 2H:
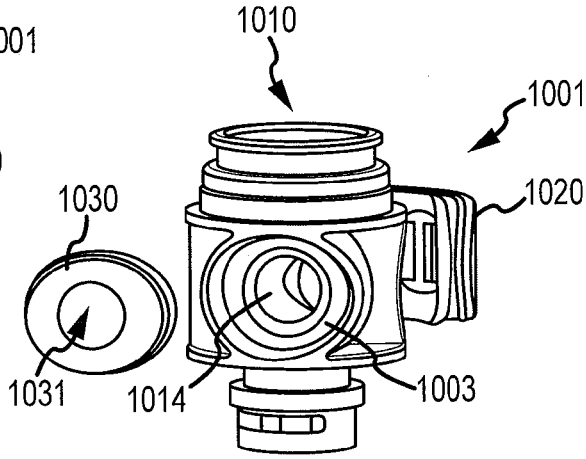
Figure 2I:
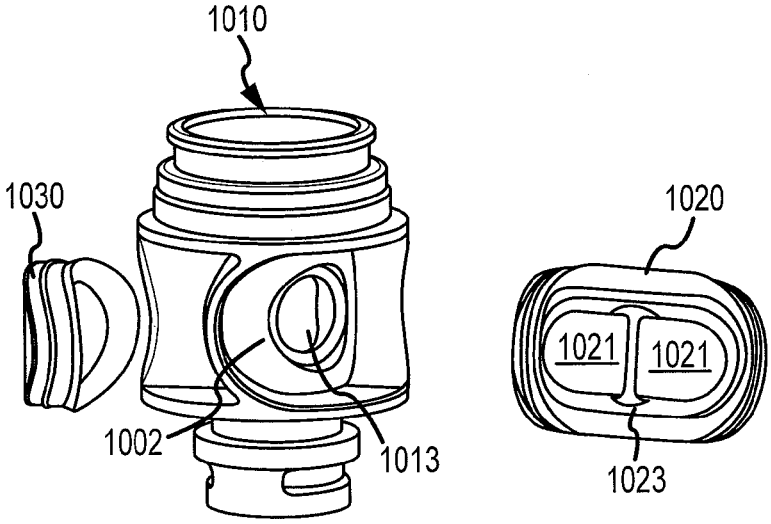
Figure 2J:
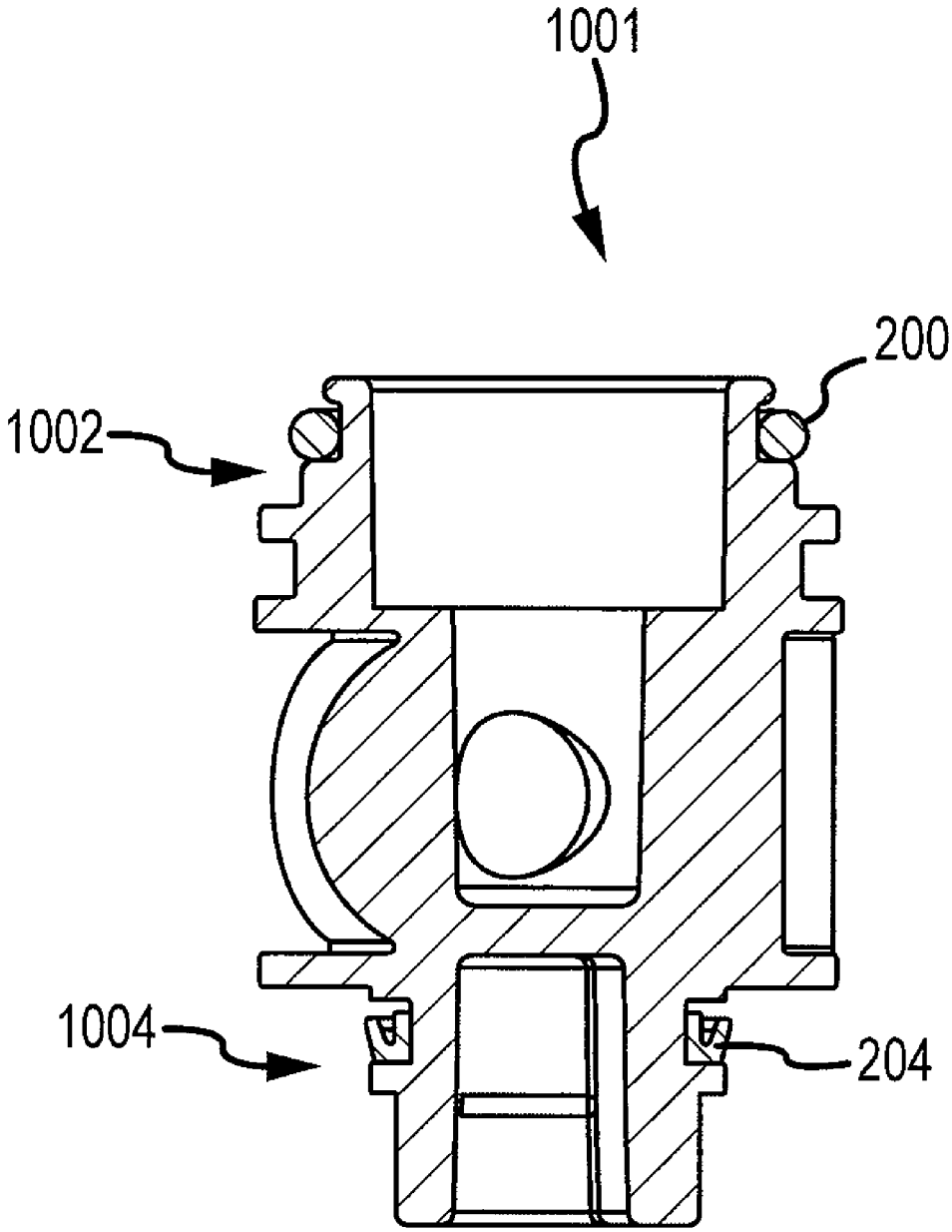
FIG. 2J depicts a cross-section view of a radial mode changer according to a further alternative implementation.

FIGS. 2G-I depict several isometric views of another embodiment of a radial mode changer 1001, which provide sealing features between the radial mode changer 1001 and the shower assembly. According to FIGS. 2G-I, radial mode changer 1001 includes a first seal cup 1020 and a second seal cup 1030 received, respectively, in a first concave recessed port 1002 and a second concave recessed port 1003 of radial mode changer 1001. In some embodiments, the first and second seal cups 1020, 1030 may have sides and rear faces sized and shaped to be sealingly accommodated in first recessed port 1002 and second recessed port 1003 surrounding annular openings 1013, 1014 formed in hollow passageway 1010 for providing a fluid connection to the seal cups 1020, 1030 from hollow passageway 1010. A front face may be sized and shaped to sealingly fit in manifold 151 when radial mode changer 1001 is arranged in a shower assembly.

Seal cups 1020, 1030 may include an exit aperture configured to serve as a water conduit between the body of radial mode changer 1001 and one manifold mode aperture, e.g., mode aperture 152, 153, or 154 (See FIGS. 3A-3F and FIGS. 6A-6H). Accordingly, the seal cups 1020, 1030 may be sized and shaped to complement the size and shape of the mode aperture. For example, in FIGS. 2G-I, seal cup 1030 defines exit aperture 1031, which serves to deliver water from the radial mode changer 1001 to one mode aperture, and is sized and shaped to feed directly to a single mode aperture. Where the seal cup is configured to serve as a conduit between the body of radial mode changer 1001 and one or more mode apertures, e.g., mode aperture 152, 153, or 154, or mode apertures 152 and 153, or 152 and 154, or 153 and 154, or 152, 153 and 154, the seal cup exit aperture may define an elongate opening and be supported by a rib so that the aperture feeds to one or multiple mode apertures. Thus, for example, as shown in FIGS. 2G-I, seal cup 1020 defines exit aperture 1021 separated by a vertical rib 1023 to provide support to the seal cup 1020. Exit apertures 1021, 1031 may generally funnel-shaped for facilitating directing water to the apertures in manifold 151.

In certain implementations, apertures may be arranged about the perimeter of radial mode changer 1001 at the same height, while in other implementations, apertures may be staggered vertically around the perimeter of radial mode changer 1001. In addition, one, two, three, four or more exit apertures 1021, 1031 may be defined in the outer surfaces of the first and second seal cups 1020, 1030. As will be discussed in greater detail below, exit aperture 1021 and/or exit aperture 1031 are fluidly connected to hollow passageway 1010 and may be utilized simultaneously or individually to deliver water to the water outflow 140.

In addition, first and second seal cups 1020, 1030 may be used to form a water-tight seal between the radial mode changer 1001 and an inner wall of the manifold 151 such that water may be expelled from radial mode changer 1001 when one or more mode apertures 152, 153, 154 is at least partially aligned with one or more exit apertures 1021, 1031. Generally, seal cups 1020, 1030 may be formed from a pliable, non-porous material, such as for example, rubber or plastic.

According to certain embodiments, radial mode changer 101/1001 may include a first open end defining an entrance to first hollow passageway 110/1010 for enabling water to flow from water inflow 130 into sealed chambers 170 via the mode changer 101/1001. In this regard, in certain embodiments, water may flow into the radial mode changer 101/1001 in a direction that is transverse to the direction in which water is expelled from radial mode changer 101/1001. For example, as shown in FIG. 1, water may flow into radial mode changer 101 axially, e.g., vertically, and may flow out of radial mode changer 101 radially, e.g., horizontally, relative to the rotational axis of the radial mode changer. Additionally, in some implementations, water may be expelled from radial mode changer 101/1001 in a direction that is transverse to the direction in which water is expelled from the shower assembly 100 water outflow 140. For example, as shown in FIG. 1, water may be expelled from the mode changer 101 substantially horizontally, and may exit the shower assembly 100 vertically. Alternatively, the direction water is expelled from the radial mode changer 101 may be at a desired angle relative to the direction in which water is expelled from the shower assembly 100.

Radial mode changer 101/1001 may be fabricated using any suitable manufacturing methods including: molding, over-molding, injection molding, reaction injection molding, machining, pressing and punching. Additionally, radial mode changer 101/1001 may be constructed of materials including metal, plastic, rubber, or combinations and variations thereof.

Figure 3F:
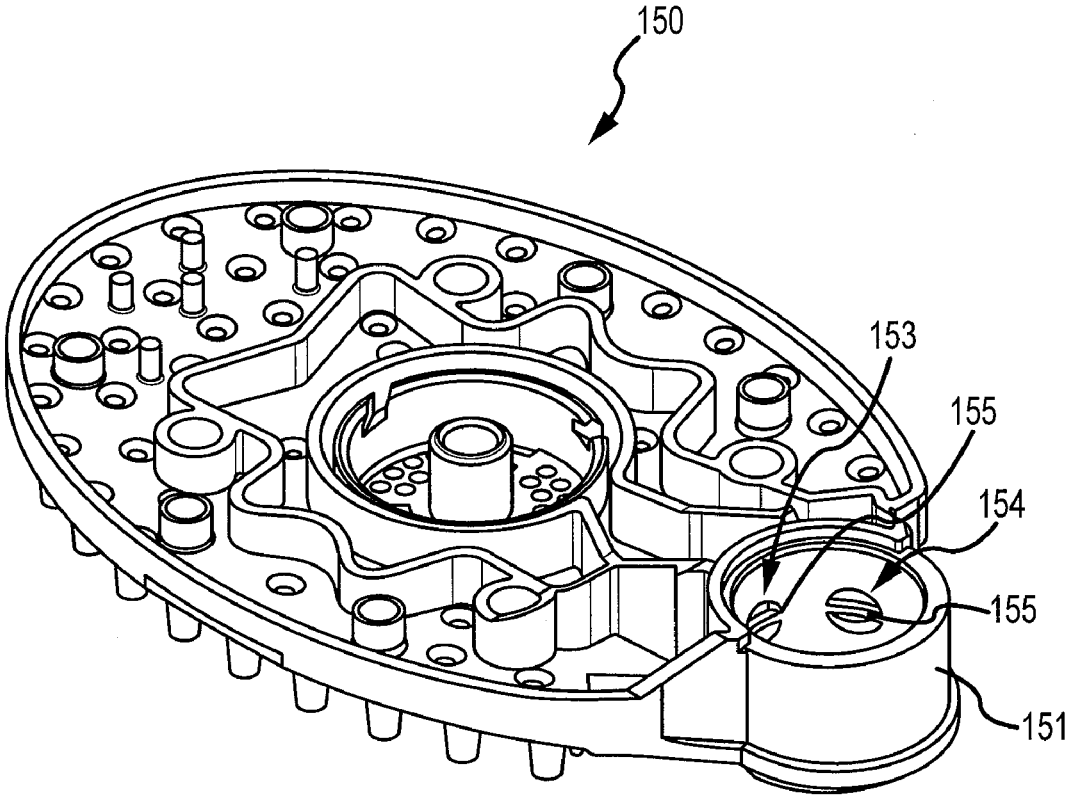
FIG. 3F depicts an isometric view of another front channel plate provided according to certain embodiments.

FIGS. 3A-3E provide isometric, top, side, bottom and horizontal cross-sectional (along line 3E-3E in FIG. 3D) views, respectively, of front channel plate 150, according to some embodiments, with radial mode changer 101 having been removed from the manifold 151. Front channel plate 150 may have an elliptical outer profile such as illustrated in FIGS. 3A-3D. Alternatively, front channel plate 150 may be configured with a circular, rectangular, polygonal, or other suitable shape. Manifold 151 includes port holes configured as mode apertures 152 (see FIG.), 153 and 154. According to some implementations, mode apertures may be aligned horizontally or may be staggered vertically around manifold 151. In addition, although mode apertures are depicted as annular openings, mode apertures may be formed into a variety of shapes, e.g., oval shaped, a narrow band, a grouping of openings associated with one channel, and each aperture may be of a different type or shape from the other. FIG. 3F illustrates horizontal ribs 155 extending across each mode aperture for providing support to cup seals 1020, 1030 as the radial mode changer 1001 rotates through the modes in order to prevent cross mode leakage.

Returning to FIGS. 3A-3B, the top surface of the front channel plate 150 may form a plurality of channels formed by partitions 156 to direct water received from three mode apertures 152, 153 and 154, via radial mode changer 101, to the appropriate spray mode apertures as selected by a user. Channels 157, 158 and 159 may be defined by walls or partitions 156 extending from the top side of the front channel plate 150. As will be described below, complementary walls extending from the bottom side of rear channel plate 160 may sealingly mate with the walls of front channel plate 150 to form chambers 170.

According to certain embodiments, a first, innermost channel 157 may be circular in shape and define a portion of the pulsating spray chamber. A second, middle channel 158 may concentrically surround a majority of first channel 157 and at least partially define a hard spray chamber. A plurality of hard spray apertures may be formed in second channel 158, each hard spray aperture having a similar diameter. Flow from radial mode changer 101 may be expelled into the second channel 158 to actuate the hard spray mode. A third, outermost channel 159 may concentrically surround a majority of second channel 158 and at least partially define an outer spray chamber. A plurality of outer spray apertures may be formed in third channel 159, each outer spray aperture having a similar diameter. Flow from radial mode changer 101 may be expelled into third channel 158 to actuate the outer spray mode.

While the present disclosure describes three concentrically arranged channels having a number of outlet apertures formed therein, it should be appreciated that a number of channels having various orientations and numbers of outlet apertures may be employed without deviating from the scope of the present disclosure.

FIGS. 4A-4E provide isometric, top plan, side elevation, bottom plan and vertical cross-sectional (taken along line 4E-4E in FIG. 4D) views, respectively, of rear channel plate 160, according to certain embodiments. Rear channel plate 160 may have a shape that is generally complementary to the shape of the front channel plate 150, i.e., the front channel plate 150 and the rear channel plate 160 have the same or similar circumferential shape. On a top surface 161 of the rear channel plate 160, a plurality of spaced attachment protrusions 167 may extend in the direction of the housing 120, when assembled. Attachment protrusions 167 may mate with complementary members of the housing 120 to stabilize the assembly of the front channel plate 150 and rear channel plate 160 within the interior of the shower assembly 100. In addition, one or more snaps 163 (see FIG. 4F) may be provided at a recessed portion 169 of a ramped region 168 to provide a flexible snap connection for mating rear channel plate 160 with the shower assembly housing 120, for example.

Figure 4A:
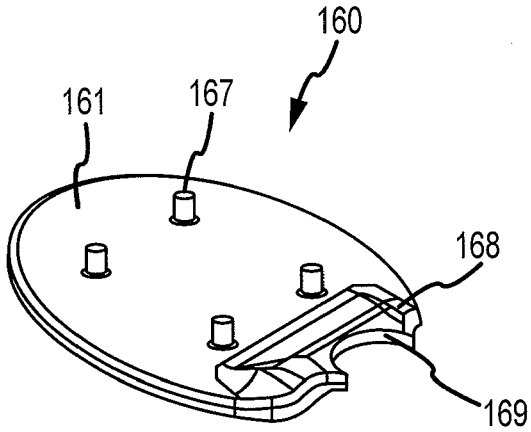
FIGS. 4A-E depict an isometric view, a top plan view, a left side elevation view, a bottom plan view, and a vertical cross-sectional view as indicated in FIG. 4D, respectively, of a rear channel plate provided according to certain embodiments.
Figure 4B:
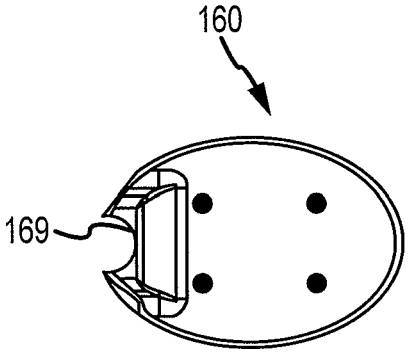
Figure 4C:
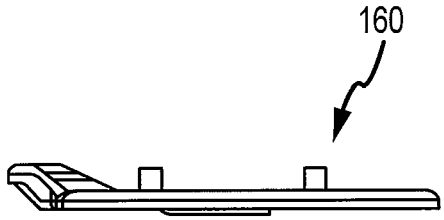
Figure 4D:
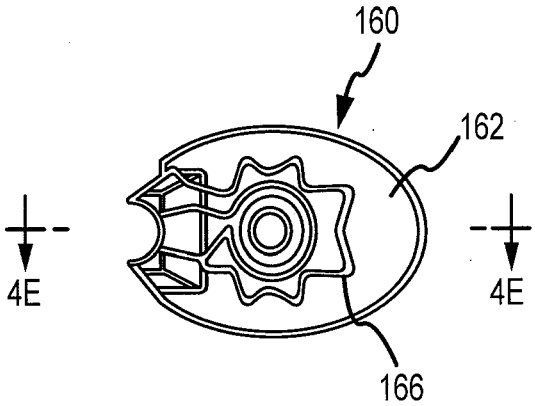
Figure 4E:
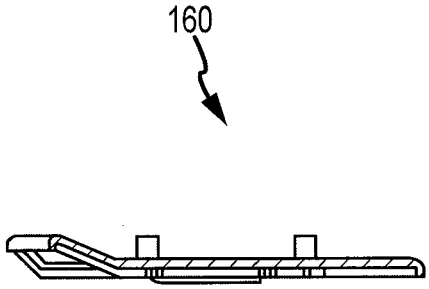
Figure 4F:
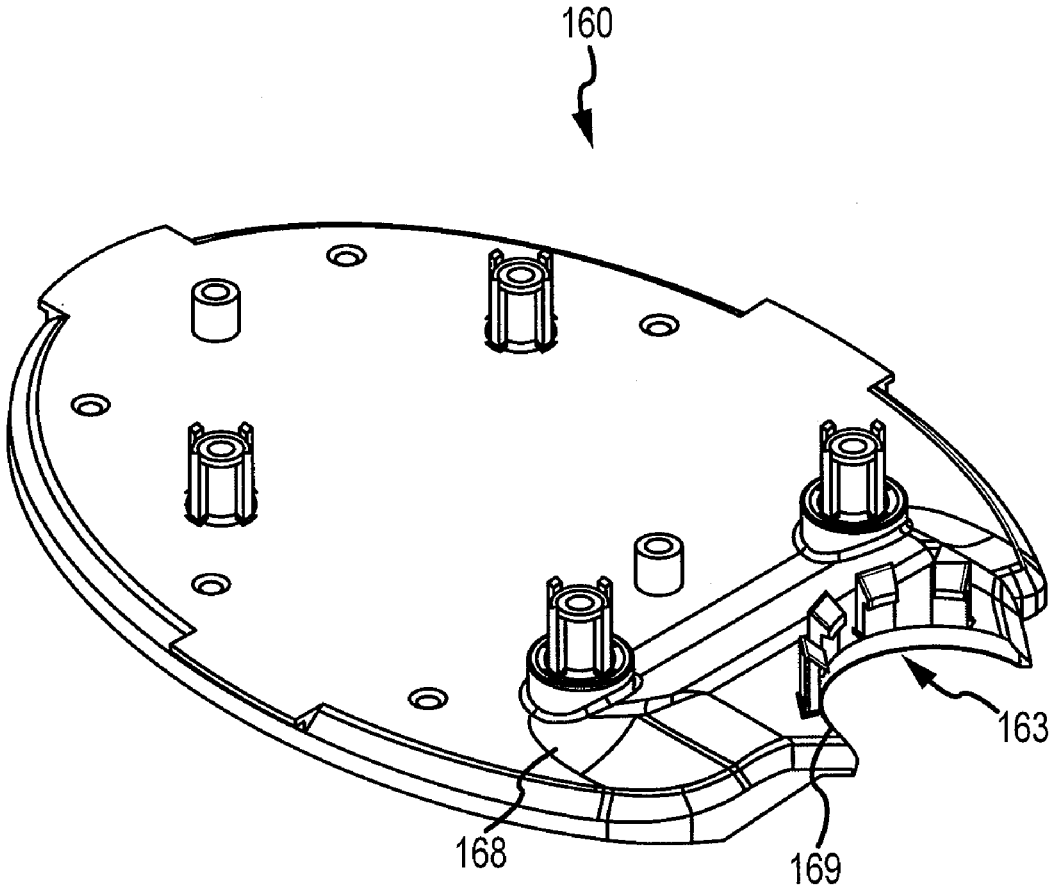
FIG. 4F depicts an isometric view of another rear channel plate provided according to certain embodiments.

With respect to FIG. 4D, a bottom view of the rear channel plate 160 is shown and as previously discussed, second surface 162 of rear channel plate 160 may be configured with a number of vertically arranged partitions 166 sized and shaped to be complementary with partitions 156 from front channel plate 150. Accordingly, partitions 166 may protrude from the second surface 162 to define channel walls corresponding to the channel walls provided in front channel plate 150. In the assembled shower assembly 100, the partitions 166 of the rear channel plate 160 sealingly mate with the partitions 156 of the front channel plate 150 to form chambers 170, which are sealed with respect to one another.

A ramped region 168 with a recessed portion 169 may be provided in a portion of the periphery of the rear channel plate 160. The ramped region 168 may correspond with a portion of the front channel plate 150 adjacent to manifold 151 in the area of the mode apertures 152, 153 and 154. In the assembled shower assembly, the recessed portion 169 may leave radial mode changer 101 exposed in order to enable radial mode changer 101 to form a seal with inflow passageway 134.

Figure 5A:
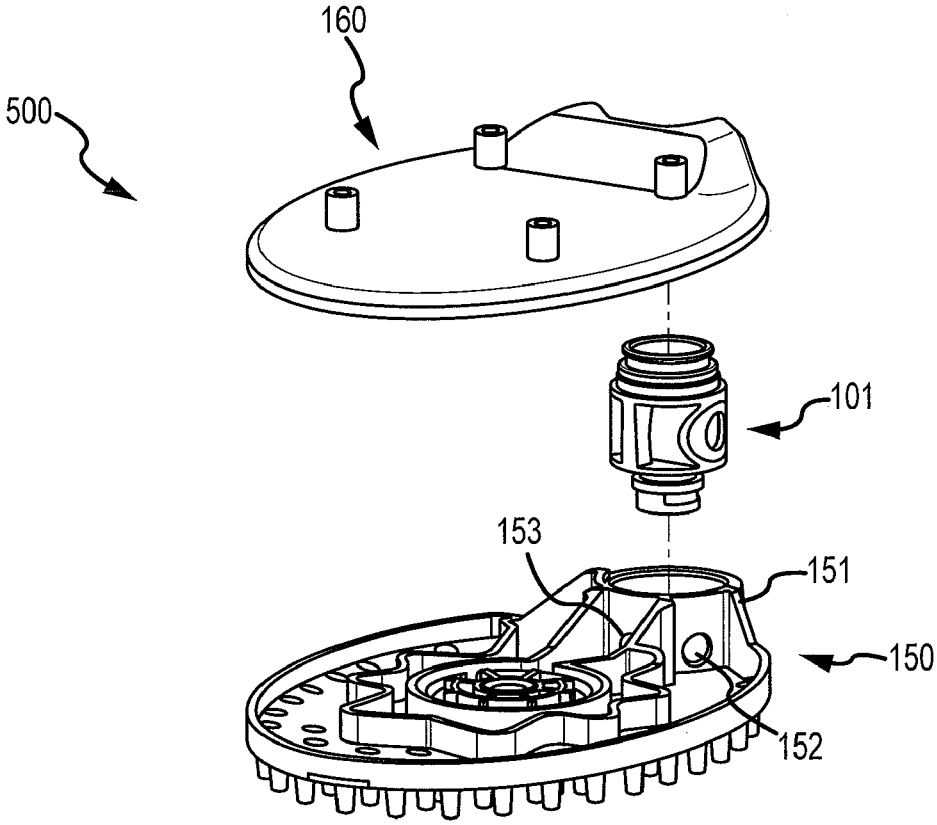
FIGS. 5A-B depict exploded isometric views of the radial mode changer and front and rear channel plates.
Figure 5B:
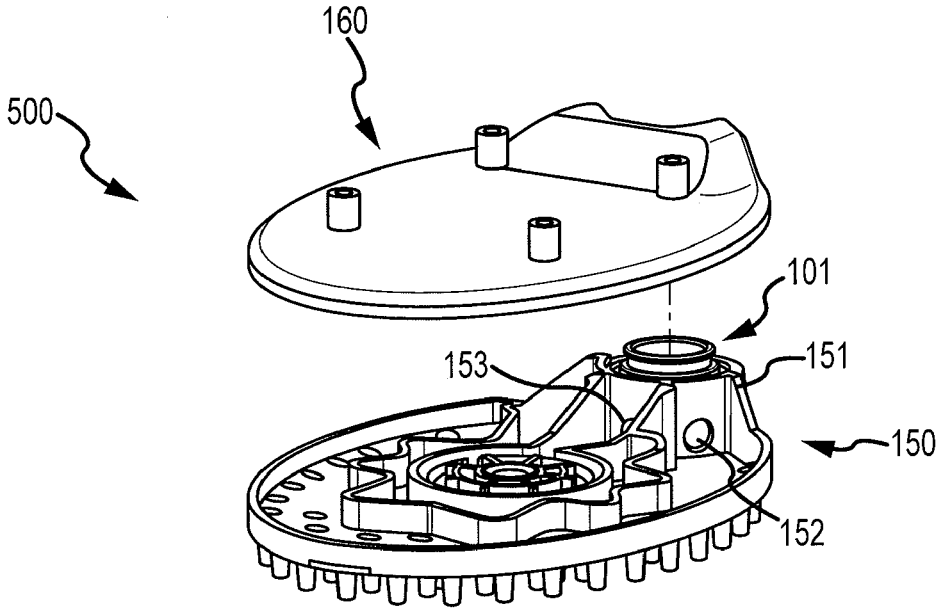

FIGS. 5A-B depict exploded isometric views of a radial mode engine 500 including a front channel plate 150, rear channel plate 160, and radial mode changer 101. Radial mode engine 500 provides a compartmentalized assembly enabling shower mode selection in an area behind the water outflow, and may be configured for use in a variety of shower assemblies, in addition to shower assembly 100. Radial mode engine may have a variety of configurations. For example, although front channel plate 150 in radial mode engine 500 provides manifold 151 and apertures 152, 153 and 154, it will be understood that portions of the manifold may be constructed from rear channel plate 160 or another structure configured to receive at least a portion of radial mode changer and to engage with the front and or rear channel plate. In addition, manifold 151 for seating radial mode changer 101, may be constructed separately from front and rear channel plate and may sealingly engage with portions of front and/or rear channel plate.

Figure 5C:
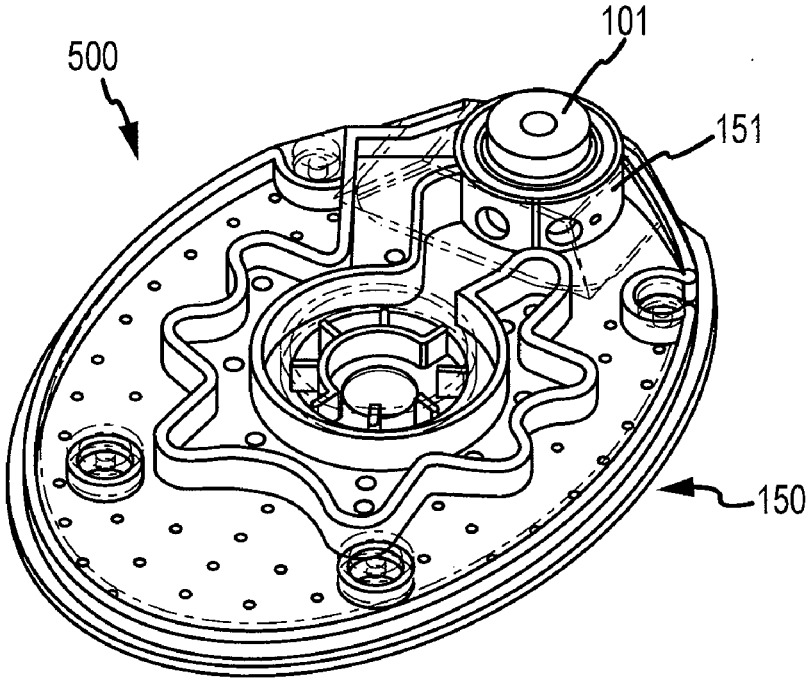
FIG. 5C depicts an isometric view of an assembly of a front channel plate, a radial mode changer, and a transparent rear channel plate.

FIG. 5C provides an isometric top side view of the radial mode changer 101 seated in manifold 151 in a perpendicular fashion relative to the direction of water spray. The manifold 151 may extend from a top surface of the front channel plate 150, be arranged axially relative to the orientation of the radial mode changer 101, and define a tubular cavity, which at least partially receives the mode changer 101. However, it will be understood that the manifold 151 and the radial mode changer 101 may be arranged at a desired angle relative to the direction of water spray, and as a result, the manifold 151 may extend from the top surface of the front channel plate at a right angle or at a desired angle.

A plurality of mode apertures 152, 153, 154 (see FIGS. 3A-3F and FIGS. 5A-5D) may be formed in a sidewall of the tubular recess of manifold 151 adjacent channels 157, 158, 159. Depending on the orientation of the mode changer 101 (i.e., the rotational position a user selects), the mode apertures 152, 153, 154 may align with one or more recessed ports 113, 114 or apertures of the mode changer 101 to actuate different spray modes. As will be described in more detail below, more than one spray mode may be actuated at a time. In one embodiment, manifold 151 may have a single mode aperture 152, 153, 154, which corresponds to each of the channels 157, 158, 159 that form chambers 170 due to rear channel plate 160 enclosing the channels to form the three chambers. That is, flow from one of the mode apertures 152, 153, 154 supplies flow to one of the three chambers associated with an independent spray mode, e.g., a hard spray, a pulse spray or an outer spray mode. Alternatively, a plurality of mode apertures may correspond to one or more of the chambers.

Figure 5D:
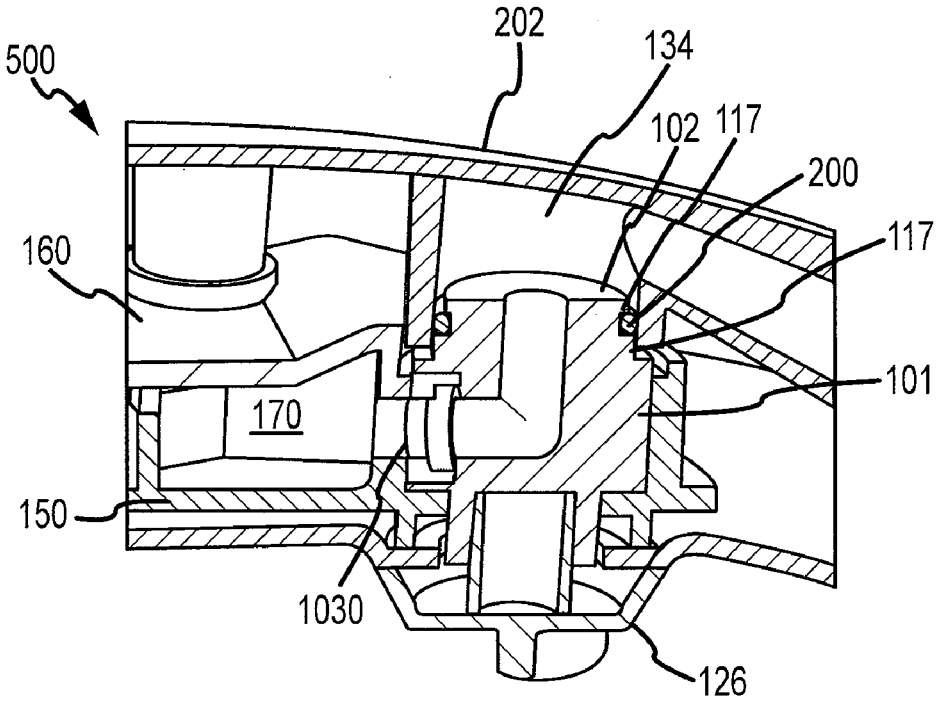
FIG. 5D is a detailed cross-sectional view of a radial mode changer arranged in a section of the interior of the channel plates and coupled to a knob at the exterior of the front channel plate.

As depicted in FIG. 5D, top recessed portion 102 of radial mode changer 101 may be sized and shaped relative to the inflow passageway 134 of water inflow 130, such that inflow passageway 134 may receive at least a portion of the top recessed portion 102. Thus, according to certain embodiments, a sealed connection may be established between the top recessed portion 102 and inflow passageway 134. In addition or alternatively, to establish a sealed connection between the inflow passageway 134 and mode changer 101, O-ring 200 may be seated between the annular ridges 117 such that when the mode changer 101 is received by the inflow passageway 134, at least a portion of the inflow passageway 134 sealingly abuts the O-ring 200. According to alternative implementations, the sealed connection between the inflow passageway 134 and top recessed portion 102 may be formed by a lip seal having a V-shaped annular groove formed in a top surface of the lip seal extending circumferentially.

With further reference to FIGS. 5C-D, when the radial mode changer 101 is assembled in manifold 151, an arrangement of three concentric cylinders is provided in which the outer cylinder of radial mode changer 101 forming body portion 106 is surrounded by an inner cylinder wall of manifold 151 at least along a portion of the height of body portion 106. Such an arrangement provides for the outer wall of body portion 106 to sealingly engage with the inner wall of manifold 151. In addition in FIG. 5D, radial mode changer further includes seal cup 1030, which also provides a sealing engagement between the radial mode changer 101 and the inner wall of manifold 151.

FIGS. 6A-H provide a top cross-sectional view of a portion of the front channel plate 150 and the radial mode changer 1001 seated in manifold 151. In some embodiments, radial mode changer 1001 may be positioned within the cavity of the manifold 151 such that the radial mode changer 1001 may rotate relative to the manifold 151. As shown, mode changer 1001 may define a plurality of flow paths for diverting flow to a desired spray mode upon rotation of radial mode changer 1001 for alignment of one or both flow paths 1110, 1210 with one more mode apertures 152, 153 and/or 154. Spray modes may be selected because first hollow passageway 1010 of mode changer 1001 terminates in flow paths 1110, 1210, each in fluid communication with at least one of the annular openings 1013, 1014 of the first and second recessed ports 1002, 1003. In this manner, flow from first hollow passageway 1010 may be channeled into one or more of the chambers 157, 158, 159.

As shown, a first flow path 1110 may provide flow through annular opening 1014 to seal cup 1030 accommodated in recessed port 1003 surrounding the annular opening 1014. Similarly, a second flow path 1210 may provide flow to annular opening 1013 so that water flows through seal cup 1020 accommodated in the recessed port 1002 surrounding the annular opening 1013. In FIGS. 6A-H, the outer surfaces of the seal cups 1020, 1030 may be contoured to seal against the inner wall of the manifold 151 such that water is expelled from the radial mode changer 1001 when one or more of the exit apertures 1021, 1031 are at least partially aligned with one or more of the mode apertures 152, 153, 154.

In an alternative embodiment, shower assembly 100 may be configured to secure radial mode changer 1001 against rotation. In this embodiment, for example, rotation of other components of the shower assembly 100, such as the housing 120 and/or manifold 151, may be rotatable relative to the radial mode changer 1001 in order to align mode apertures 152, 153, 154 with exit apertures 1021, 1031.

Figure 6A:
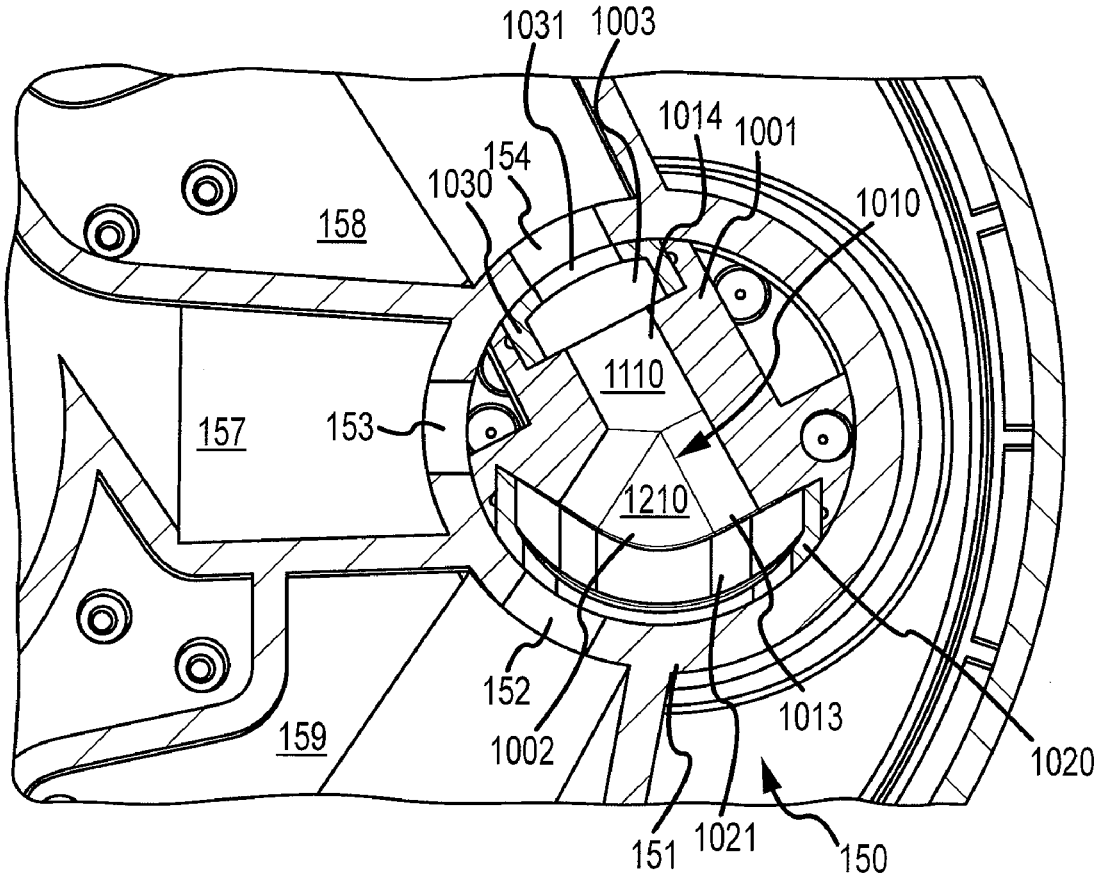
FIGS. 6A-H are a series of horizontal cross-sectional views of a radial mode changer arranged in a section of the front channel plate at various positions relative to the manifold of the front channel plate corresponding to different spray modes or combinations of spray modes.

FIGS. 6B-6H provide views similar to FIG. 6A, the radial mode changer 1001 having been rotated to various positions relative to the manifold 151 corresponding to seven different spray modes including three independent modes, three combination modes and a pause mode. The orientation of exit apertures 1021, 1031 may be configured such that flow at a given time may be provided to each spray mode individually, or any combination of two spray modes.

Figure 6B:
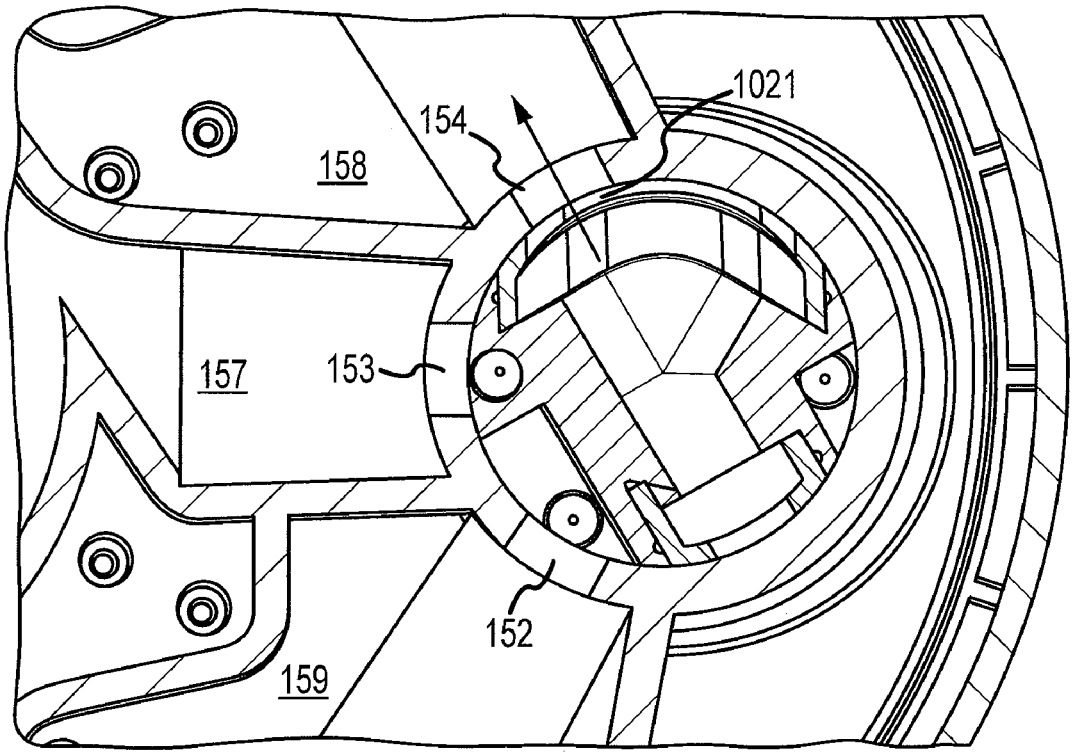

Referring to FIG. 6B, the radial mode changer 1001 has been rotated such that exit aperture 1021 is at least partially aligned with mode aperture 154, corresponding to the hard spray chamber 158. Thus, flow from the first hollow passageway 1010 may be directed to the hard spray chamber 158 and spray may emerge from the nozzles arranged in the hard spray chamber 158.

Figure 6C:
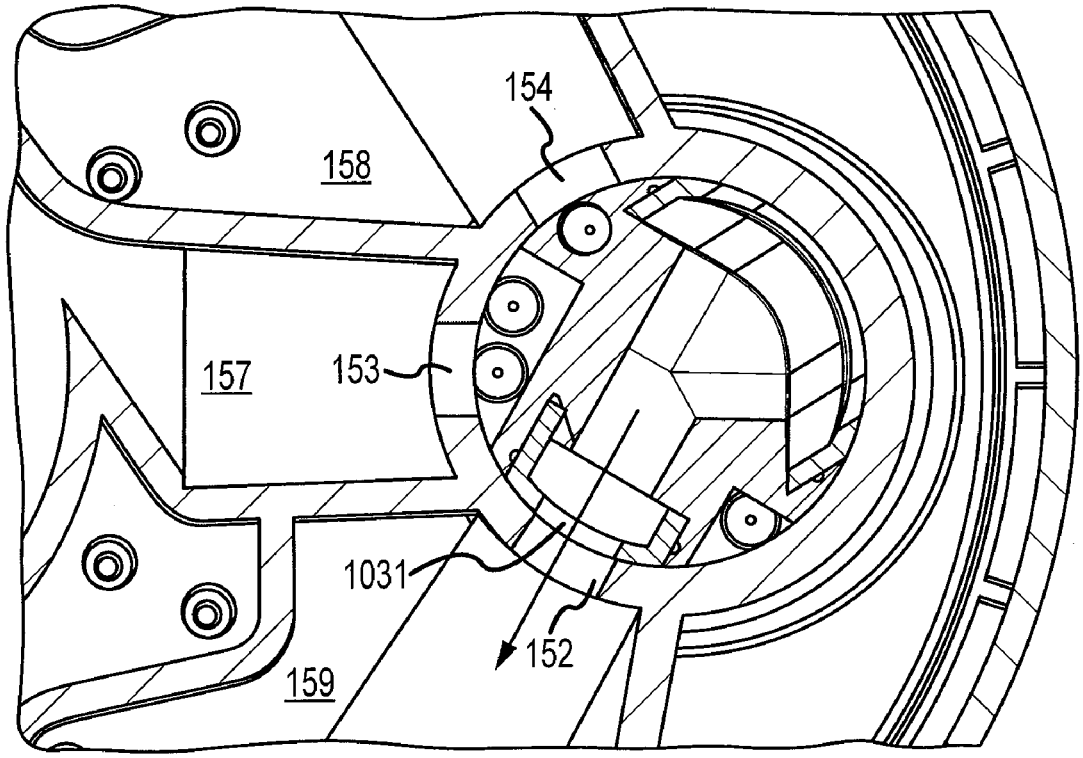

In FIG. 6C, the radial mode changer 1001 has been rotated for alignment of exit aperture 1031 with mode aperture 152 corresponding to the outer spray chamber 159. Thus, flow from the first hollow passageway 1010 may be directed to the outer spray chamber 159 and spray may emerge from the nozzles arranged on the outer area of the shower head in fluid connection with the outer spray chamber 159.

Figure 6D:
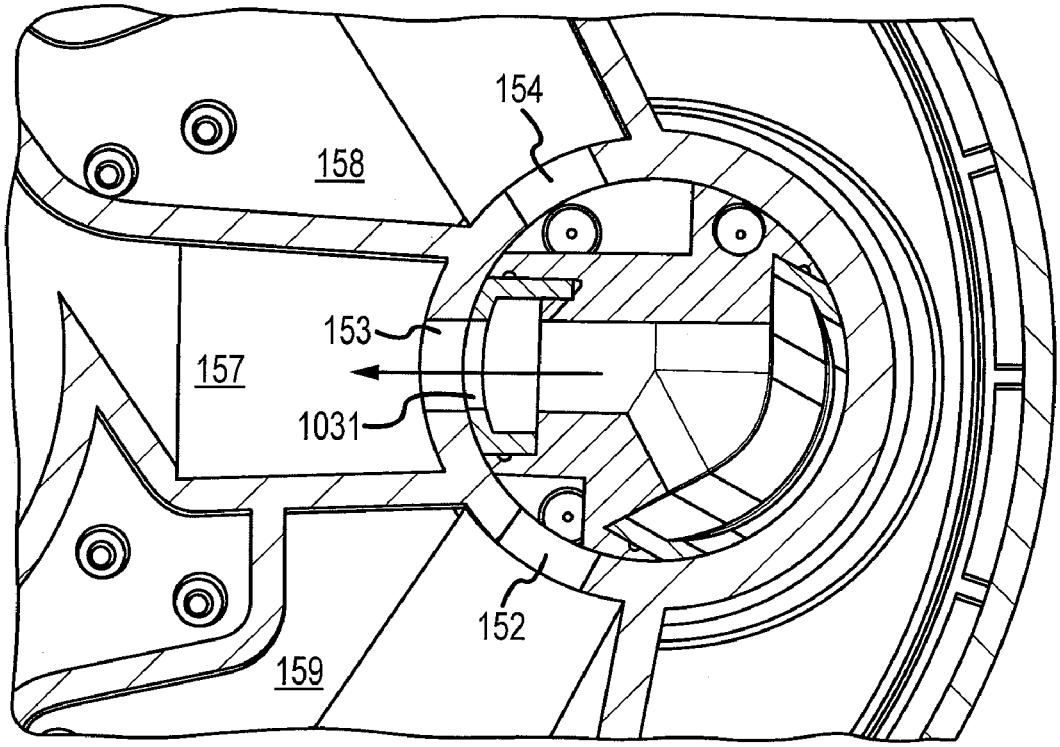

Referring to FIG. 6D, the radial mode changer 1001 is rotated for exit aperture 1031 to align with the mode aperture 153 corresponding to the pulse spray chamber 157. Thus, flow from the first hollow passageway 1010 may be directed to the pulse spray chamber 157 and pulsed spray may emerge from the apertures formed in the pulse spray chamber 157.

Figure 6E:
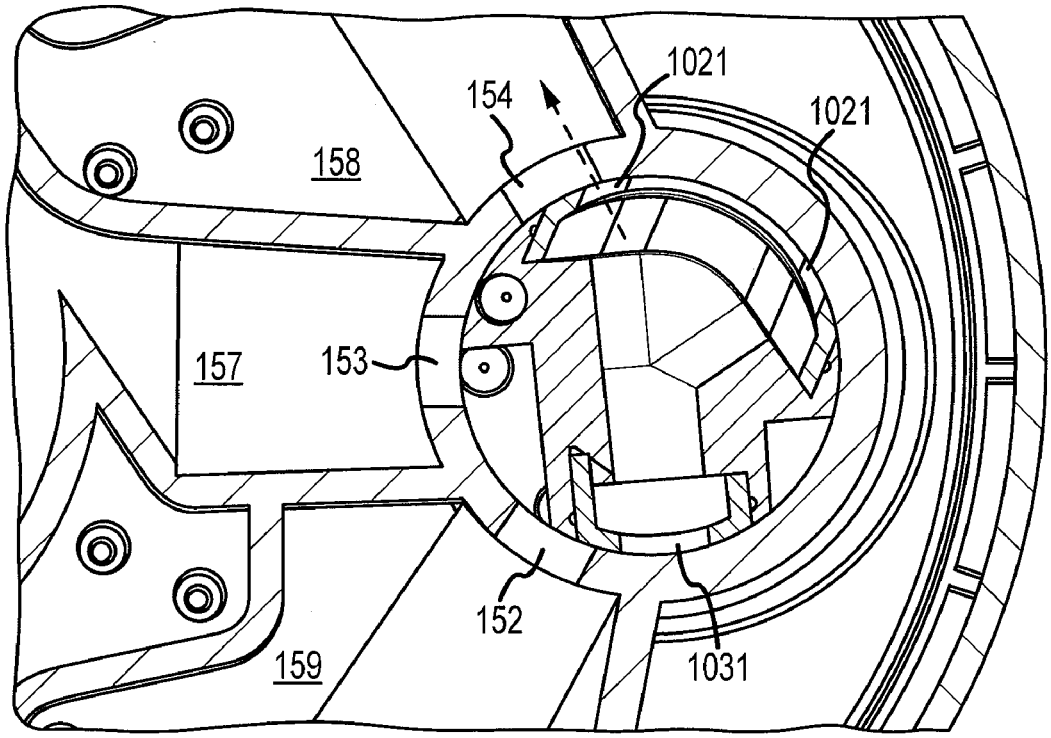

In some embodiments, radial mode changer 1001, and specifically, exit apertures 1021, 1031 may be configured such that one mode is always at least partially selected allowing for a reduced amount of flow from a spray chamber. Such a configuration aims to prevent "dead-heading" of water flow in the radial mode changer 1001. Referring to FIG. 6E, the radial mode changer 1001 has been rotated so the shower assembly 100 is in a pause spray mode. In one embodiment, in the pause spray mode, the exit aperture 1021 may be partially aligned with mode aperture 154. Alternatively, in the pause spray mode, either of the exit apertures 1021, 1031 may be partially aligned with any of the mode apertures 152, 153 and/or 154.

Figure 6F:
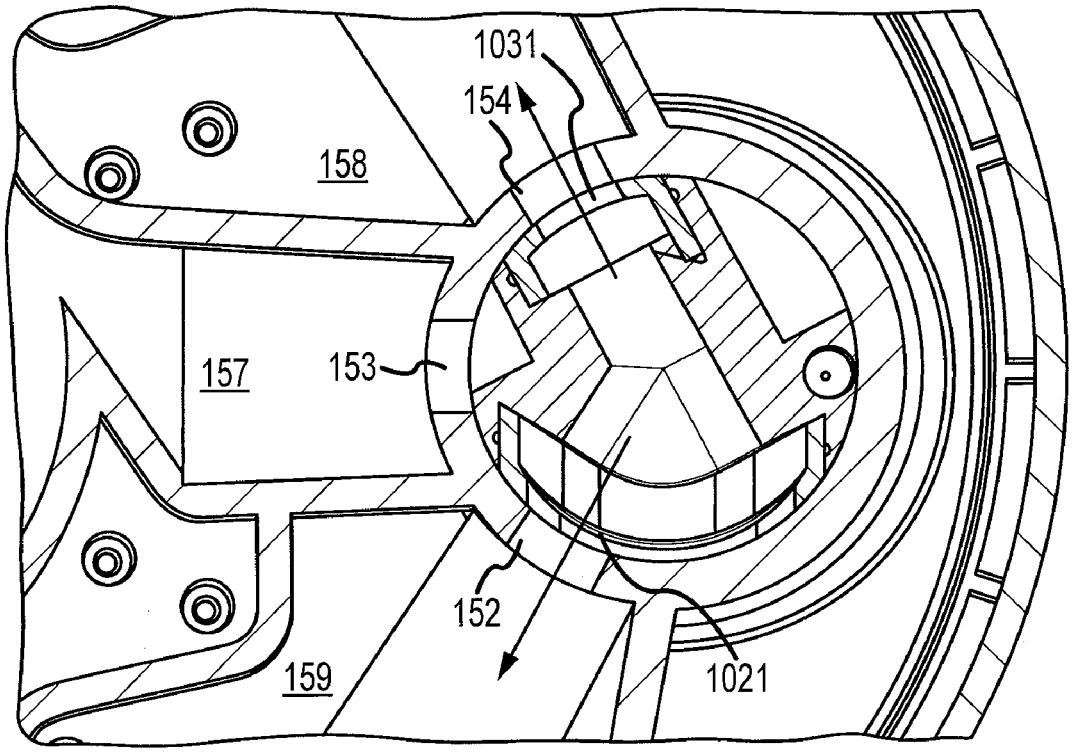

In some embodiments, radial mode changer 1001 may be configured so that flow at a given time may be provided to a combination of two or more spray modes. Referring to FIG. 6F, the radial mode changer 1001 has been rotated such that exit aperture 1021 is at least partially aligned with mode aperture 152, corresponding to the outer spray chamber 159, and exit aperture 1031 is at least partially aligned with mode aperture 154, corresponding to the hard spray chamber 158. Thus, flow from the first hollow passageway 1010 is split via mode changer 1001 into two paths and is directed to both of the outer spray chamber 159 and the hard spray chamber 158. In use, spray may thus emerge from the nozzles formed in the hard spray and outer spray chambers 158, 159.

Figure 6G:
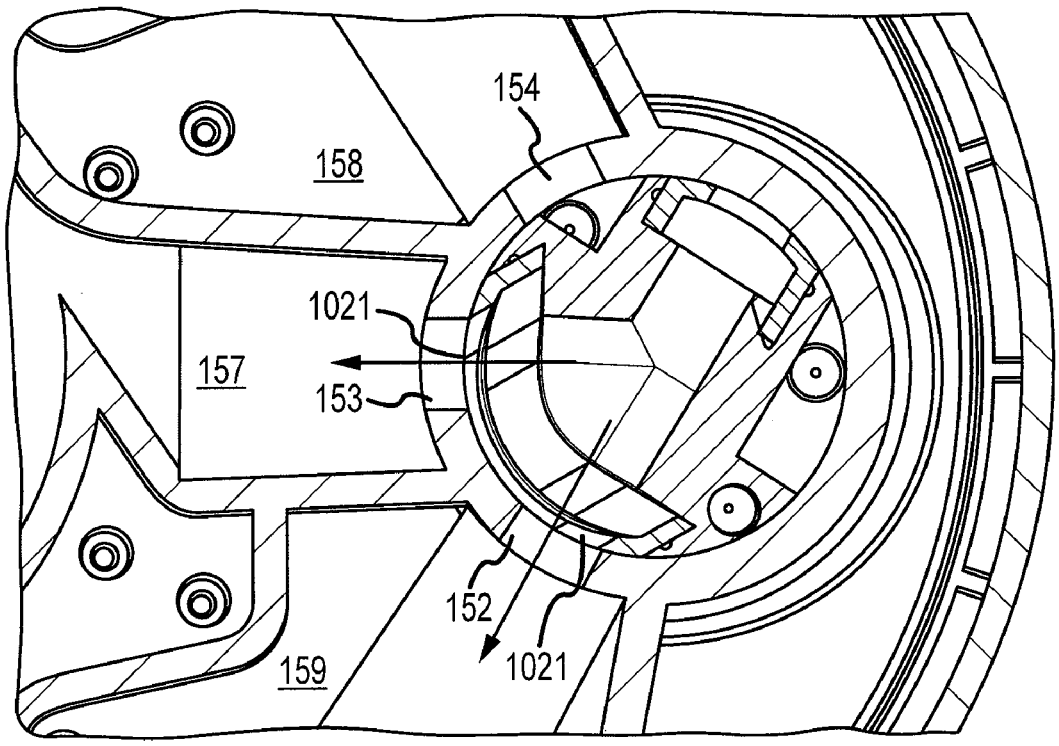

Referring to FIG. 6G, the radial mode changer 1001 has been rotated for partial alignment of exit aperture 1021 with mode apertures 152 and 153, respectively, corresponding to the outer spray chamber 159 and pulse spray chamber 157. Thus, flow from the first hollow passageway 1010 is split via mode apertures 153 and 152 as the flow from exit aperture 1021 is directed to both the pulse spray chamber 157 and the outer spray chamber 159, respectively. Accordingly, in use, spray emerges from the nozzles formed in the pulse spray and outer spray chambers 157, 159.

Figure 6H:
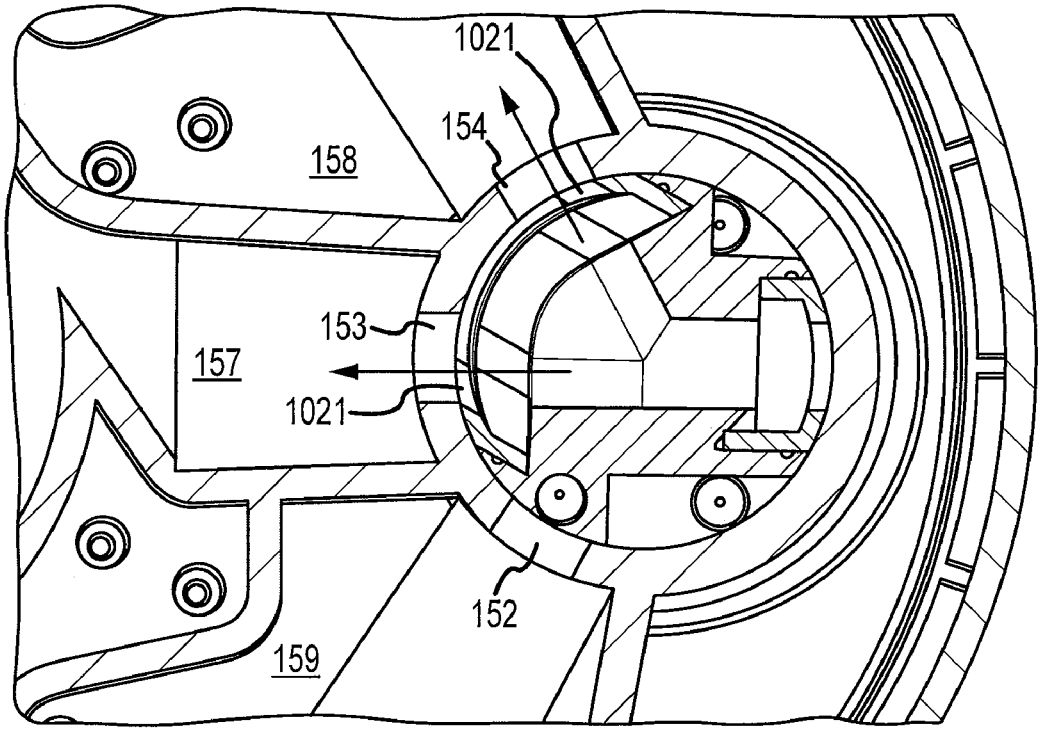

Referring to FIG. 6H, the radial mode changer 1001 is rotated to partially align exit aperture 1021 with mode apertures 154, 153, corresponding to the pulse spray chamber 157 and hard spray chamber 158, respectively. Thus, flow from the first hollow passageway 1010 emerging from exit aperture 1021 is split via mode apertures 153 and 154 and is directed to both the pulse spray chamber 157 and hard spray chamber 158, respectively, and spray emerges from the nozzles corresponding to the pulse spray and outer spray chambers 157, 158.

Figure 7:
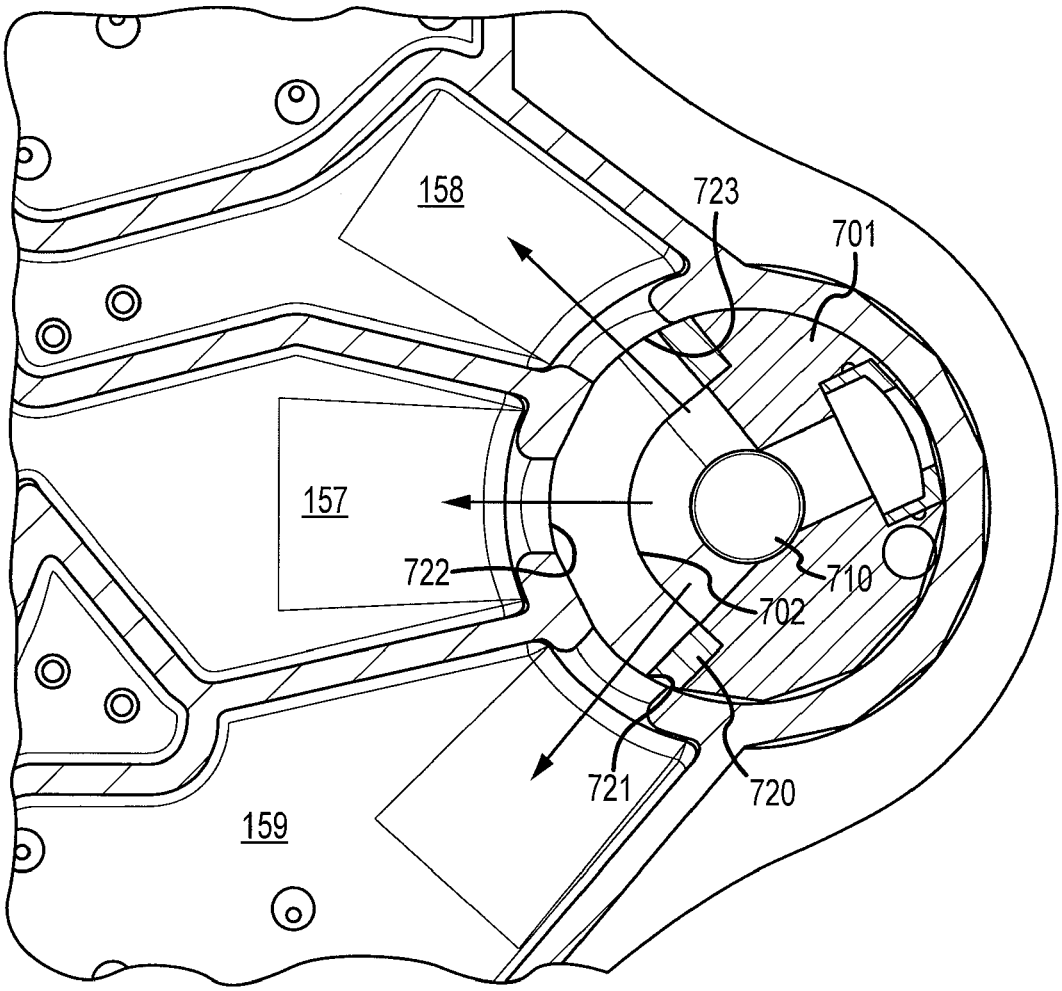
FIG. 7 is a cross-section view of a radial mode changer arranged in a section of the front channel plate according to an alternative embodiment.

FIG. 7 provides a view of an alternative radial mode changer 701 that may be incorporated into the shower assembly 100 according to the present disclosure. As illustrated, radial mode changer 701 is configured similarly to those of previous embodiments. In contrast, however, a recessed port 702 extends circumferentially around radial mode changer 701 a greater distance relative to previous embodiments, and has a seal cup 720 accommodated therein. Seal cup 720 may be provided with one or multiple exit apertures for providing flow to each of the mode apertures of the manifold. In the embodiment of FIG. 7, the radial mode changer 701 may be configured such that in at least one orientation of the mode changer 701, flow is provided to each of the pulse spray chamber 157, hard spray chamber 158, and outer spray chamber 159. For example, in one orientation, each of the exit apertures 721, 722, 723 may be at least partially aligned with mode apertures 152, 153, 154, corresponding to the hard spray chamber 157, pulse spray chamber 158, and outer spray chamber 159, respectively. Thus, flow from the first hollow passageway 710 may be directed to each the pulse spray chamber 157, hard spray chamber 158, and outer spray chamber 159 and spray may emerge from the nozzles formed in the chambers 157, 158 and 159. Upon rotation of the radial mode chamber 701, two modes may be selected, e.g., outer spray and pulse modes may be engaged when radial mode changer 701 is rotated counterclockwise, or hard and pulse modes may be engaged when radial mode changer 701 is rotated clockwise. Alternatively, one mode may be selected upon rotation of radial mode chamber 701 further in a clockwise or counterclockwise direction to align with a single mode aperture so that either hard or outer spray modes may be singly provided.

Figure 8A:
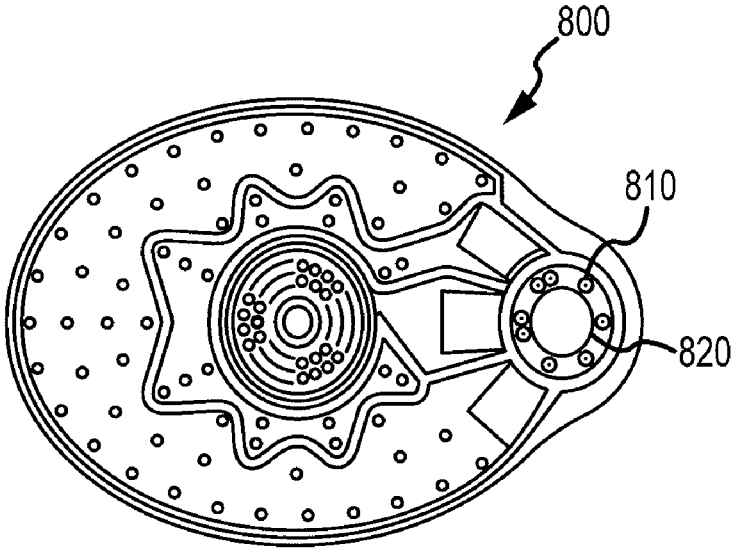
FIG. 8A is a top plan view of a front channel plate according to certain embodiments.
Figure 8B:
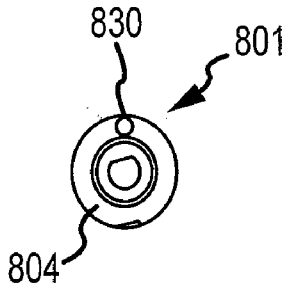
FIG. 8B is a bottom plan view of a radial mode changer according to certain embodiments.

In some embodiments, rotation of mode changer knob 126 to effect a change in spray mode is accompanied by tactile indication to a user that a desired spray mode has been achieved. Referring to FIGS. 8A and 8B, the front channel plate 800 (see FIG. 8A) may be provided with a plurality of indentations or holes 810 on annular rim 820, while radial mode changer 801 (see FIG. 8B) is configured with a passage defined by a protruding annular lip 830 arranged in a bottom surface of the body portion 804. When radial mode changer 801 is seated on annular rim 820 in the assembled shower assembly, as the mode changer knob (see FIG. 1) coupled to radial mode changer 801 is turned, the annular lip 830 drops into a hole 810 providing the user with a tactile indication that the radial mode changer 801 has changed position. In some embodiments, the indicator arrangement of holes 810 in annular rim 820 and annular lip 830 of radial mode changer 801 may provide tactile indications that correspond to the exit apertures of the radial mode changer 801 being aligned with one or more mode apertures. Thus, when one of the holes 810 receives annular lip 830, a predetermined spray mode, such as for example one of the spray modes described in FIGS. 6A-6G, may be established, as indicated by a tactile pause or bump in rotational motion during mode selection.

In use, the various configurations of the radial mode changer, along with the mode changer knob provide advantages that allow a user to select the desired spray mode without having to grasp around the entire perimeter of the shower assembly, which may possibly accidentally adjust the angle or direction the shower assembly is pointing. Additionally, while using a shower assembly configured according to certain embodiments, a user's hand may be less likely to interfere with the spray while adjusting the spray mode via the mode changer knob arranged behind the outflow nozzles, thus avoiding undesired splashing. In addition, because the perimeter of the shower assembly from which water exits need not be rotated to select the spray mode, the configuration of the area from which water outflow is provided is not limited to rotatable designs.

While embodiments are described in the context of a hand-held shower assembly, it will be appreciated that the embodiments may be incorporated into a variety of shower assemblies. For example, a radial mode changer and its associated components may be incorporated into a wall-mount shower head. The wall mount shower head may function similarly to the hand-held shower assembly, except that a wall-protruding water pipe may be coupled to a threaded water inflow assembly.

Shower assemblies, and the components thereof, may be fabricated using any suitable manufacturing methods including, without limitation, molding, injection molding, reaction injection molding, machining, pressing and punching. Additionally, components forming shower assemblies may be constructed of materials such as for example, metal, plastic, rubber, or combinations and variations thereof.

From the above description and drawings, it will be understood by those of ordinary skill in the art that the particular embodiments shown and described are for purposes of illustration only and are not intended to limit the scope of the present disclosure. Those of ordinary skill in the art will recognize that the present disclosure may be embodied in other specific forms without departing from its spirit or essential characteristics. References to details of particular embodiments are not intended to limit the scope of the disclosure.

What is claimed is:

1. A shower assembly having a plurality of spray modes for expelling water through different nozzles, the shower assembly comprising a housing having a water inflow and a water outflow;

a manifold defining a cavity having a sidewall, wherein two or more mode apertures are formed in the sidewall of the cavity, and wherein each of the mode apertures corresponds to one of the plurality of spray modes and is in fluid communication with the water outflow; and a radial mode changer formed in a shape complementary to the manifold cavity, the radial mode changer defining a hollow passageway in fluid communication with the water inflow, further defining two or more recessed ports in fluid communication with the hollow passageway, and further including a seal structure provided on a top portion of the radial mode changer; wherein the radial mode changer is received in the cavity of the manifold such that the radial mode changer may be rotated relative to the manifold to align at least one of the recessed ports with at least one of the mode apertures such that water may flow from the water inflow into the water outflow via the radial mode changer; and the top portion of the radial mode changer extends axially above the manifold whereby the seal structure seals against the water inflow.

2. The shower assembly of claim 1, wherein water flows into the radial mode changer in a direction which is transverse to the direction in which water is expelled from the radial mode changer.

3. The shower assembly of claim 2, wherein the water inflow terminates in an inflow passageway that extends axially downward towards a top surface of the radial mode changer, and the inflow passageway receives the top portion of the radial mode changer to seal against the seal structure.

4. The shower assembly of claim 3, wherein the seal structure further comprises one or more annular ridges provided on the top portion of the radial mode changer;

a annular seal is seated adjacent the one or more annular ridges; and when the radial mode changer is received within manifold, the inflow passageway sealingly abuts the annular seal.

5. The shower assembly of claim 1, further comprising a mode changer knob extending from a bottom surface of the housing, wherein the mode chamber knob is coupled to the radial mode changer such that rotation of the knob effects rotation of the radial mode changer.

6. The shower assembly of claim 1, wherein the water outflow further comprises:

a front channel plate; and a rear channel plate; wherein when the front channel plate and the rear channel plate are attached together, the plates form a plurality of continuous mode chambers that are each separate from the other of the plurality of the continuous mode chambers, and one or more outlet flow paths are defined by the plurality of continuous mode chambers.

7. The shower assembly of claim 6, wherein the recessed ports of the radial mode changer are configured relative to the mode apertures of the manifold such that water flow at a given time may be provided to each of the mode chambers individually, or any combination of two or more spray modes.

8. The shower assembly of claim 6, wherein one or more of the plurality of mode chambers comprise a plurality of outlet apertures, each of the outlet apertures corresponding to a respective nozzle such that flow into the mode chambers may be expelled from the shower assembly via the nozzles.

9. The shower assembly of claim 1, wherein one or more seal cups are accommodated in the one or more recessed ports, and wherein the one or more seal cups each define one or more exit apertures for directing water to the water outflow.

10. A shower assembly comprising a housing having a water inflow and a water outflow;

a showerhead operably connected to the housing and including a first group of nozzles and a second group of nozzles;

a manifold defining a manifold cavity and having a sidewall;

a plurality of mode apertures formed in the sidewall of the manifold cavity; and a radial mode changer at least partially received within the manifold cavity, including a cylindrical body defining a first hollow passageway in fluid communication with the water inflow; and two or more recessed ports in fluid communication with the hollow passageway; and further having a top portion including a seal structure extending from a top end of the cylindrical body axially above the manifold when received therein; wherein when the radial mode changer is rotated to a first position relative to the manifold to align one of the two or more recessed ports with one of the plurality of mode apertures, water from the water inflow flows through the radial mode changer to provide water outflow to the first group of nozzles; and when the radial mode changer is rotated to a second position relative to the manifold, the one of the two or more recessed ports aligns with two of the mode apertures such that water from the water inflow flows through the radial mode changer to provide water outflow to the second group of nozzles.

11. The shower assembly of claim 10, wherein the top portion has a first open end in communication with the first hollow passageway.

12. The shower assembly of claim 11, wherein the radial mode changer further comprises a bottom portion extending from a bottom end of the cylindrical body axially below the manifold when received therein and defining a second hollow passageway separated from the first hollow passageway by a wall forming a top end of the bottom portion.

13. The shower assembly of claim 10, wherein the first group of nozzles does not include any nozzles from the second group of nozzles.

14. The shower assembly of claim 10, wherein the second group of nozzles includes nozzles from the first group of nozzles.

* * * * *